United States Patent [19]

Takada et al.

[11] Patent Number: 4,526,864

[45] Date of Patent: Jul. 2, 1985

[54] SILVER HALIDE PHOTOGRAPHIC LIGHT-SENSITIVE MATERIAL

[75] Inventors: Shun Takada; Kaoru Onodera; Takashi Kadowaki, all of Odawara, Japan

[73] Assignee: Konishiroku Photo Industry Co., Ltd., Tokyo, Japan

[21] Appl. No.: 566,820

[22] Filed: Dec. 29, 1983

[30] Foreign Application Priority Data

Dec. 30, 1982 [JP] Japan ..... 57-228285

[51] Int. Cl.[3] ..... G03C 7/26

[52] U.S. Cl. ..... 430/551; 430/505; 430/552; 430/553; 430/558

[58] Field of Search ..... 430/551, 505, 552, 553, 430/558

[56] References Cited

U.S. PATENT DOCUMENTS

| | | | |
|---|---|---|---|
| 4,174,220 | 11/1979 | Taguchi et al. | 430/551 |
| 4,228,235 | 10/1980 | Okonogi et al. | 430/551 |
| 4,268,593 | 5/1981 | Leppard et al. | 430/551 |

*Primary Examiner*—J. Travis Brown

*Attorney, Agent, or Firm*—Finnegan, Henderson, Farabow, Garrett, and Dunner

[57] ABSTRACT

A silver halide photographic material. A support contains at least one silver halide emulsion layer that has in combination at least one cyan coupler of Formula I with at least one dye image stabilizer of Formula II or III.

43 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material, and more particularly to a silver halide color photographic light-sensitive material which is suitably usable for making photographic prints.

2. Description of the Prior Art and Problems Thereof

The formation of a dye image by use of a silver halide color photographic light-sensitive material is generally carried out in the manner that an aromatic primary amine-type color developing agent itself, when reducing the exposed silver halide particles inside a silver halide color photographic light-sensitive material, is oxidized to produce an oxidized product, and this oxidized product then reacts with a coupler that is in advanced contained in the silver halide color photographic light-sensitive material to thereby form a dye.

As the coupler, because the color reproduction is made by the subtractive color process, three-primary color couplers are used to form three different dyes of yellow, magenta and cyan colors.

The fundamental requirements for the nature of each of these couplers are: the coupler shall have a large solubility in high-boiling organic solvents; shall have no satisfactory dispersibility and dispersion stability in a silver halide emulsion that it is hardly deposited inside the emulsion; shall be so excellent in the spectral absorption characteristic as well as in the color tone as to be capable of forming a clear dye image over a wide color reproduction range; and the resulting dye image from the coupler shall be highly resistant to light, heat and moisture. Especially the cyan coupler must be so improved as to have well-balanced resistances to light, heat and moisture as the dye image preservability.

Conventionally known cyan couplers include 2,5-diacylaminophenol-type cyan couplers, the compounds of phenol with the second and fifth positions thereof being each substituted by an acylamino radical, as described in, e.g., U.S. Pat. No. 2,895,826, and Japanese Patent Publication Open to Public Inspection (hereinafter referred to as Japanese Patent O.P.I. Publication) Nos. 112038/1975, 109630/1978 and 163537/1980.

The use of these 2,5-diacylaminophenol-type cyan couplers improves the anti-dark-discoloration characteristic, i.e., the resistance to heat and moisture, but is not deemed capable of sufficiently improving the resistance to light, and, in addition, is disadvantageous in respect that the resulting dye becomes discolored to be yellowish in the light with time.

Some proposals have until now been made to use dye image stabilizing agents in combination with couplers for the purpose of improving the anti-light-discoloration characteristic of couplers, such as particularly the resistance to light, capability of preventing yellow-discoloration caused by light and the like. As the dye image stabilizing agent there are those dye image stabilizing agents having a phenolic carboxyl radical or a radical capable of being hydrolyzed to produce a phenolic hydroxyl radical, such as, e.g., bisphenols as described in Japanese Patent Examined Publication Nos. 31256/1973 and 31625/1973; pyrogallol, gallic acid and esters thereof as in U.S. Pat. No. 3,069,2625; 6-hydroxychromans as in U.S. Pat. Nos. 3,432,300 and 3,574,627; 5-hydroxychromans as in U.S. Pat. No. 3,573,050; and 6,6'-dihydroxy-2,2'-bis-spirochromans as in Japanese Patent No. 20977/1974. However, these dye image stabilizing agents display sufficiently their dye image stabilizing effect when used in combination with magenta couplers, but do not show any dye image stabilizing effect when used in combination with cyan couplers, particularly 2-acylaminophenol-type cyan couplers, and on the contrary, some of the compounds even deteriotate the anti-dark-discoloration characteristic of cyan couplers.

OBJECTS OF THE INVENTION

It is an object of the present invention to provide a silver halide photographic light-sensitive material capable of forming a dye image excellent in total image preservability characteristics as a result of being so improved as to be free from being possibly discolored to become yellowish as well as to have well-balanced resistances to light, heat and moisture.

We have now found that the above object of the present invention can be accomplished by a silver halide photographic light-sensitive material comprising a support having thereon at least one silver halide emulsion layer containing in combination at least one of those cyan couplers having the following Formula [I] and at least one of those compounds having the following Formula [II] or [III]:

Formula [I]

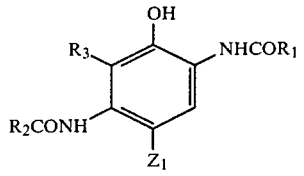

wherein $R_1$ is an alkyl radical, an aryl radical, a cycloalkyl radical or a heterocyclic radical; $R_2$ is an alkyl radical or an aryl radical; $R_3$ is a hydrogen atom, a halogen atom, an alkyl radical or an alkoxy radical; and $Z_1$ is a hydrogen atom or a radical that can be split off by the reaction with the oxidized product of an aromatic primary amine-type color developing agent, Formula [II]

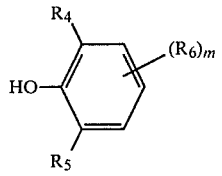

wherein $R_4$ and $R_5$ each is an alkyl radical; $R_6$ is a hydrogen atom, an alkyl radical, —$NHR_6'$ or —$SR_6'$ (wherein $R_6'$ is a monovalent organic radical) or —$COOR_6''$ (wherein $R_6''$ is a hydrogen atom or a monovalent organic radical); and m is an integer of from 0 to 3,

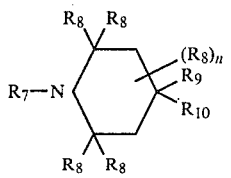

Formula [III]

wherein $R_7$ is a hydrogen atom, a hydroxyl radical, an oxy radical (—O radical), —$SOR_7'$ radical, —$sO_2R_7''$ radical (wherein $R_7'$ and $R_7''$ each is a monovalent organic radical), an alkyl radical, an alkenyl radical, an alkinyl radical or a —$COR_7'''$ (wherein $R_7'''$ is a hydrogen atom or a monovalent organic radical); each $R_8$ is an alkyl radical; $R_9$ and $R_{10}$ each may be a hydrogen atom or a —OCOR' radical (wherein R' is a monovalent organic radical) or $R_9$ and $R_{10}$ together may form a heterocyclic radical; and n is an integer of from 0 to 4.

DETAILED DESCRIPTION OF THE INVENTION

In the present invention, the alkyl radical represented by the $R_1$ of Formula [I] includes, e.g., methyl, ethyl, butyl, hexyl, tridecyl, pentadecyl, heptadecyl, fluorine-substituded, the so-called polyfluoroalkyl, and the like radicals. The aryl radical represented by the $R_1$ includes, e.g., phenyl naphthyl, and preferably phenyl. The heterocyclic radical represented by the $R_1$ includes, e.g., pyridyl, furan, and the like radicals. The cycloalkyl radicals represented by the $R_1$ includes, e.g., cyclopropyl, cyclohexyl, and the like radicals. Any of these radicals represented by the $R_1$ is allowed to have a single substituent or a plurality of substituents. For example, those substituents introducible into phenyl are typified by halogen atoms (such as fluorine, chlorine, bromine, etc.), alkyl radicals (such as methyl, ethyl, propyl, butyl, dodecyl, etc.), hydroxyl radical, cyano radical, nitro radical, alkoxy radicals (such as methoxy, ethoxy, etc.), alkylsulfonamido radicals (such as methylsulfonamido, octylsulfonamido, etc.), arylsulfonamido radicals (such as phenylsulfonamido, naphthylsulfonamido, etc.), alkylsulfamoyl radicals (such as butylsulfamoyl, etc.), arylsulfamoyl radicals (such as phenylsulfamoyl, etc.), alkyloxycarbonyl radicals (such as methyloxycarbonyl, etc.), aryloxycarbonyl radicals (such as phenyloxycarbonyl, etc.), aminosulfonamido radical, acylamino radicals, carbamoyl radical, sulfonyl radical, sulfinyl radical, sulfoxy radical, sulfo radical, aryloxy radicals, alkoxy radicals, carboxyl radical, alkylcarbonyl radicals, arylcarbonyl radicals, aminocarbonyl radical, and the like. Not less than two of these substituents may be introduced into the phenyl. The preferred radicals represented by the $R_1$ are polyfluoroalkyl radicals, phenyl or halogen atoms, alkyl radicals, alkoxy radicals, alkylsulfonamido radicals, arylsulfonamido radicals, alkylsulfamoyl radicals, arylsulfamoyl radicals, alkylsulfonyl radicals, arylsulfonyl radicals, alkylcarbonyl radicals, arylcarbonyl radicals and phenyl radicals having not less than one cyano radicals as substituents.

The alkyl radical represented by the $R_2$ is a straight-chain or branched-chain alkyl radical including, e.g., methyl, ethyl, propyl, butyl, pentyl, octyl, nonyl, tridecyl, and the like; and the aryl radical includes, e.g., phenyl, naphtyl, and the like. Any of these radicals represented by the $R_2$ may have a single substituent or a plurality of substituents. For example, those substituents introducible into the phenyl are typified by a halogen atom (such as fluorine, chlorine, bromine, etc.), alkyl radicals (such as methyl, ethyl, propyl, butyl, dodecyl, etc.), hydroxyl radical, cyano radical, nitro radical, alkoxy radicals (such as methoxy, ethoxy, etc.), alkylsulfonamido radicals (such as methylsulfonamido, octylsulfonamido, etc.), arylsulfonamido radicals (such as phenylsulfonamido, naphthylsulfonamido, etc.), alkylsulfamoyl radicals (such as butylsulfamoyl, etc.), arylsulfamoyl radicals (such as phenylsulfamoyl, etc.), alkyloxycarbonyl radicals (such as methyloxycarbonyl, etc.), aryloxycarbonyl radicals (such as phenyloxycarbonyl, etc.), aminosulfonamido radical, acylamino radicals, carbamoyl radical, sulfonyl radical, sulfinyl radical, sulfoxy radical, sulfo radical, aryloxy radicals, alkoxy radicals, carboxyl radical, alkylcarbonyl radicals, arylcarbonyl radicals, aminocarbonyl radical, and the like. Not less than two of these substituents may be introduced into the phenyl.

The halogen represented by the $R_3$ is, e.g., fluorine, chlorine, or bromine. The alkyl radical includes, e.g., methyl, ethyl, propyl, butyl, dodecyl, and the like. The alkoxy radical includes, e.g., methoxy, ethoxy, propyloxy, butoxy, and the like.

The preferred ones of those cyan couplers having Formula [I] in the present invention are those compounds having the following Formula [IV]:

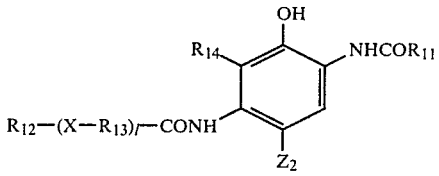

Formula [IV]

wherein $R_{11}$ is a polyfluoroalkyl radical or a phenyl radical. This phenyl is allowed to have a single substituent or a plurality of substituents, typical examples of which include halogen atoms (such as fluorine, chlorine, bromine, etc.), alkyl radicals (such as methyl, ethyl, propyl, butyl, octyl, dodecyl, etc.), hydroxyl radical, cyano radical, nitro radical, alkoxy radicals (such as methoxy, ethoxy, etc.), alkylsulfonamido radicals (such as, methylsulfonamido, octylsulfonamido, etc.), arylsulfonamido radicals (such as phenylsulfonamido, naphthylsulfonamido, etc.), alkylsulfamoyl radicals (such as butylsulfamoyl, etc.), arylsulfamoyl radicals (such as phenylsulfamoyl, etc.), alkyloxycarbonyl radicals (such as methyloxycarbonyl, etc.), aryloxycarbonyl radicals (such as phenyloxycarbonyl, etc.), and the like. Not less than two of these substituents may be introduced into the phenyl.

The preferred radicals represented by the $R_{11}$ include polyfluoroalkyl radicals, phenyl radical, halogens (preferably fluorine, chlorine and bromine), alkylsulfonamido radicals (preferably o-methylsulfonamido, p-octylsulfonamido and o-dodecylsulfonamido), arylsulfonamido radicals (preferably phenylsulfonamido), alkylsulfamoyl radicals (preferably butylsulfamoyl), arylsulfamoyl radicals (preferably phenylsulfamoyl), alkyl radicals (preferably methyl, trifluoromethyl), alkoxy radicals (preferably methoxy and ethoxy), and phenyl radicals having one cyano radical or not less than two cyano radicals.

$R_{12}$ is an alkyl radical or an aryl radical. Each of the alkyl and aryl radicals is allowed to have a single substituent or a plurality of substituents, typical examples of which include halogens (such as fluorine, chlorine, bromine, etc.), hydroxyl radical, carboxyl radical, alkyl radicals (such as methyl, ethyl, propyl, butyl, octyl, dodecyl, etc.), aralkyl radicals, cyano radical, nitro radical, alkoxy radicals (such as methoxy, ethoxy), aryloxy radicals, alkylsulfonamido radicals (such as methylsulfonamido, octylsulfonamido, etc.), arylsulfonamido radicals (such as phenylsulfonamido, naphthylsulfonamido, etc.), alkylsulfamoyl radicals (such as butylsulfamoyl, etc.), arylsulfamoyl radicals (such as phenylsulfamoyl, etc.), alkyloxycarbonyl radicals (such as methyloxycarbonyl, etc.), aryloxycarbonyl radicals (such as phenyloxycarbonyl, etc.), aminosulfonamido radicals (such as dimethylaminosulfonamido, etc.), alkylsulfonyl radicals, arylsulfonyl radicals, alkylcarbonyl radicals, arylcarbonyl radicals, aminocarbonylamido radical, carbamoyl radical, sulfinyl radical, and the like. Not less than two of these radicals may be introduced into the alkyl or aryl radical.

The preferred radicals represented by the $R_{12}$, when l is equal to 0, are alkyl radicals, and, when l is equal to or more than 1, are aryl radicals. The more preferred radical represented by the $R_{12}$, when l is equal to 0, is an alkyl radical having from 1 to 22 carbon atoms (preferably methyl, ethyl, propyl, butyl, octyl or dodecyl), and when l is equal to or more than 1, is phenyl or phenyl having one substituent or not less than two substituents such as alkyl radicals (preferably t-butyl, t-amyl, octyl), alkylsulfonamido radicals (preferably butylsulfonamido, octylsulfonamido, dodecylsulfonamido), arylsulfonamido radicals (preferably phenylsulfonamido), aminosulfonamido radicals (preferably dimethylaminosulfonamido), alkyloxycarbonyl radicals (preferably methyloxycarbonyl, butyloxycarbonyl), or the like.

$R_{13}$ is an alkylene radical; a straight-chain or branched-chain alkylene radical having from 1 to 20 carbon atoms, and more particularly an alkylene radical having from 1 to 12 carbon atoms.

$R_{14}$ is a hydrogen atom or a halogen atom (fluorine, chlorine, bromine or iodine), and preferably a hydrogen atom.

l is an integer of 0 to 5, and preferably 0 or 1.

X is a divalent radical such as —O—, —CO—, —COO—, —OCO—, $—SO_2NR_x'—$, $—NR_x'SO_2R_x''—$, —S—, —SO—, or $—SO_2—$, wherein $R_x'$ and $R_x''$ each is an alkyl. The preferred one of the X is —O—, —S—, —SO—, or $—SO_2—$.

$Z_2$ is a hydrogen atom, a halogen atom or a radical that can be split off by the reaction with the oxidized product of an aromatic primary amine-type color developing agent.

In Formulas [I] and [IV], the radicals represented by the $Z_1$ and $Z_2$, which can be split off by the reaction with the oxidized product of an aromatic primary amine-type color developing agent, are well-known to those skilled in the art. The radicals, in the coupler-containing layers or other layers of a silver halide color photographic light-sensitive material, changes the reactivity of the coupler or split from the coupler to advantageously act to fulfill their development inhibiting, bleach inhibiting and color compensating functions. The radicals are typified by, e.g., halogens, slkoxy radicals, aryloxy radicals, arylazo radicals, thioether radicals, carbamoyloxy radical, acyloxy radicals, imido radical, sulfonamido radical, thiocyano radical or heterocyclic radicals (such as oxazolyl, diazolyl, triazolyl, tetrazolyl, etc.) and the like. The most preferred radical represented by the $Z_1$ or $Z_2$ is hydrogen or a halogen.

The following are typical examples of the cyan couplers having Formula [I], but the cyan couplers are not limited to the following examples.

(I-1)

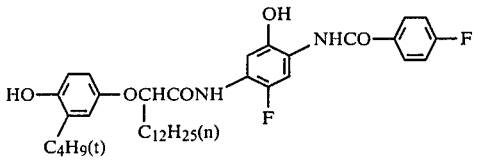

(I-2)

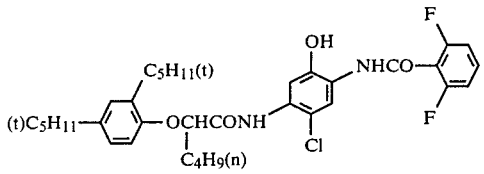

(I-3)

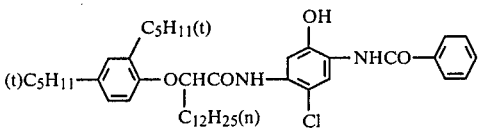

(I-4)

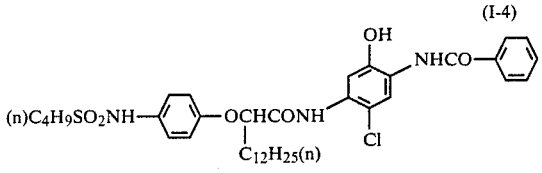

(I-5)

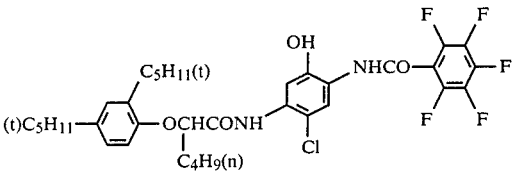

(I-6)

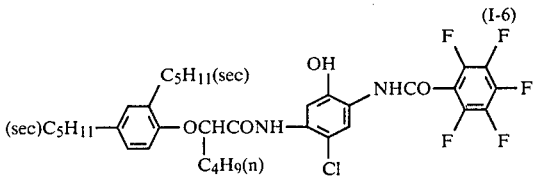

-continued
(I-7)
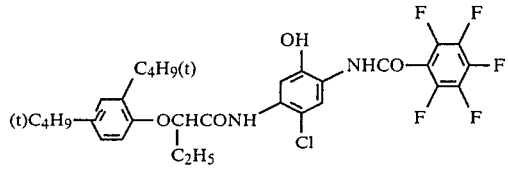
(I-8)
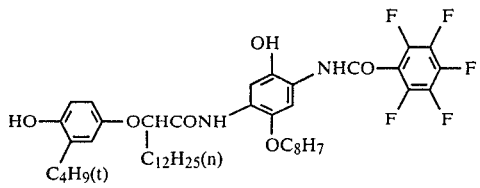
(I-9)
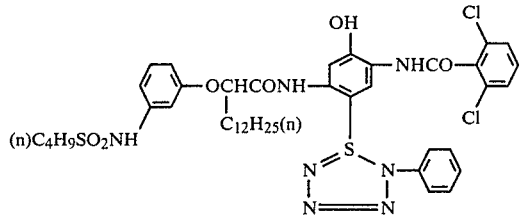
(I-10)
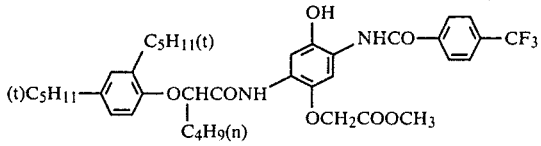
(I-11)
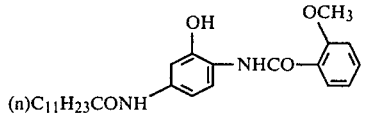
(I-12)
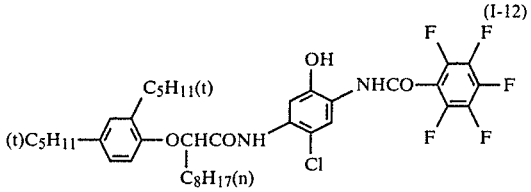
(I-13)
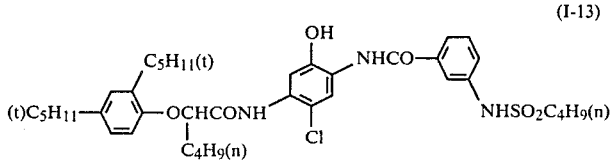
(I-14)
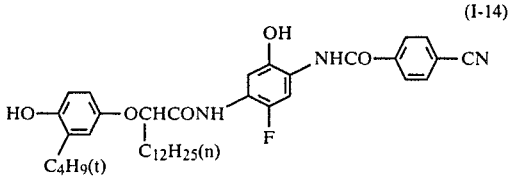
(I-15)
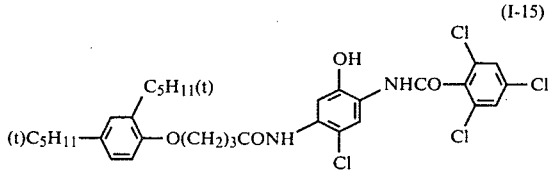
(I-16)
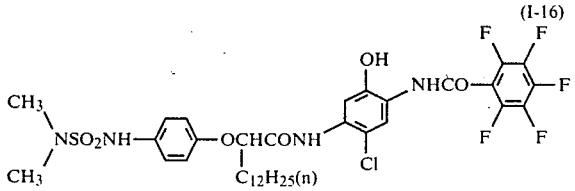
(I-17)
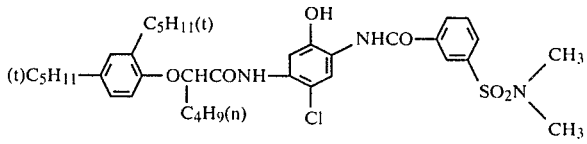
(I-18)
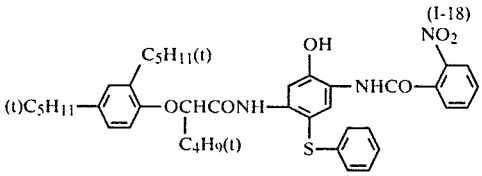

-continued
(I-19)
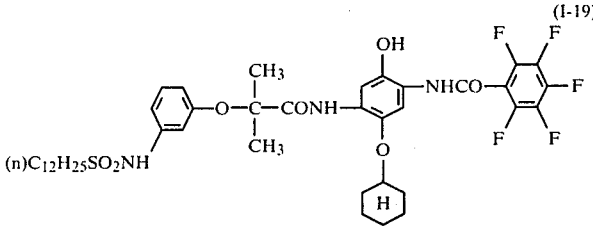
(I-20)
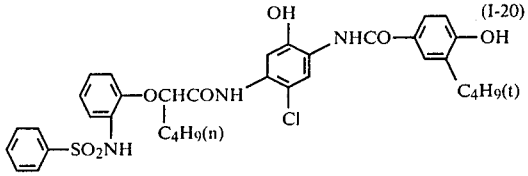
(I-21)
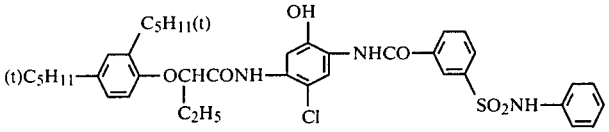
(I-22)
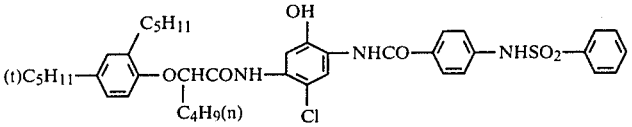
(I-23)
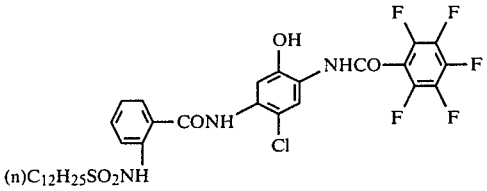
(I-24)
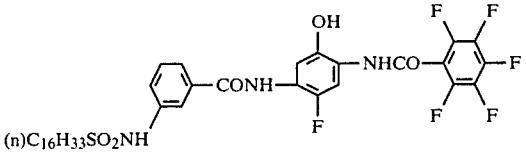
(I-25)
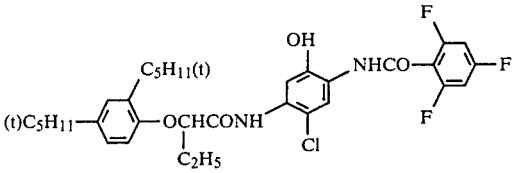
(I-26)
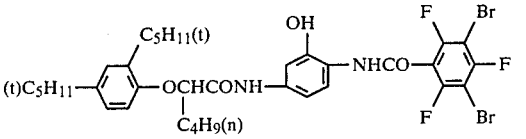
(I-27)
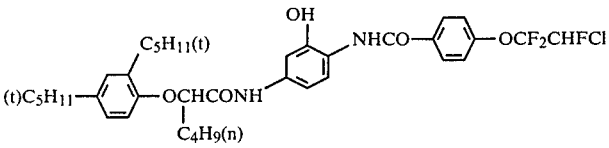
(I-28)
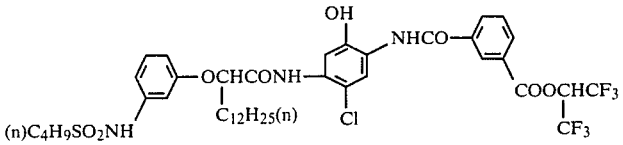
(I-29)
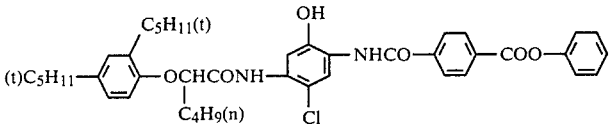

-continued
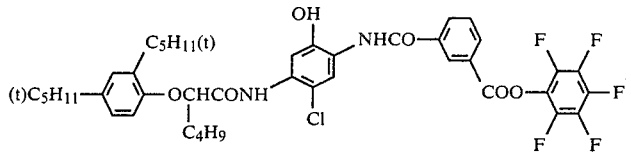
(I-30)
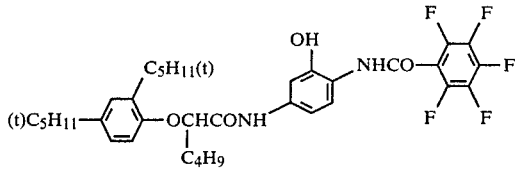
(I-31)
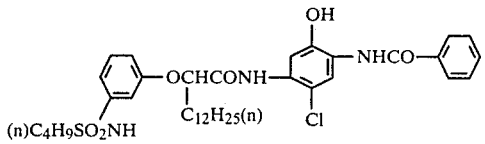
(I-32)
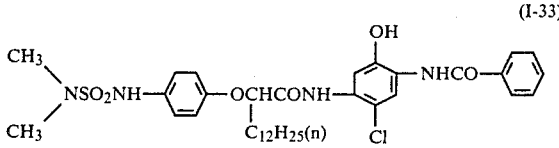
(I-33)
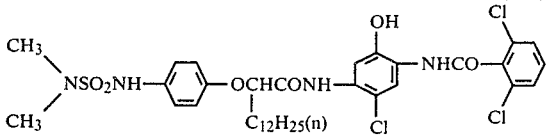
(I-34)
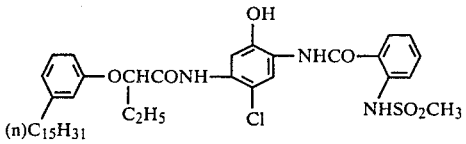
(I-35)
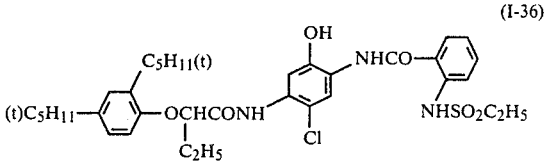
(I-36)
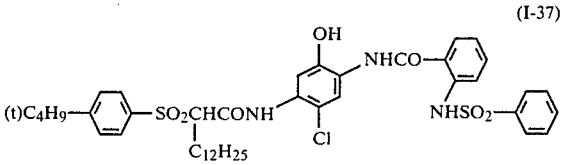
(I-37)
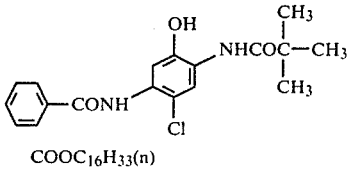
(I-38)
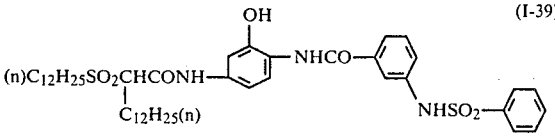
(I-39)
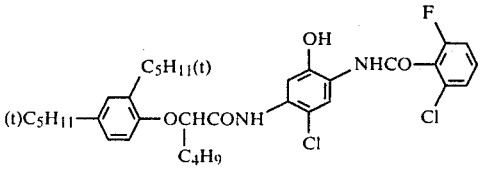
(I-40)
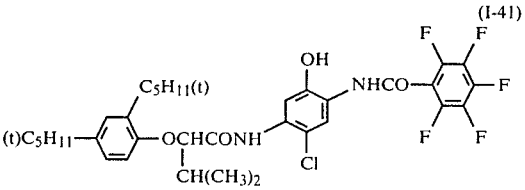
(I-41)
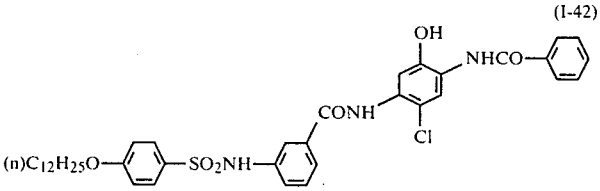
(I-42)

-continued (I-43)

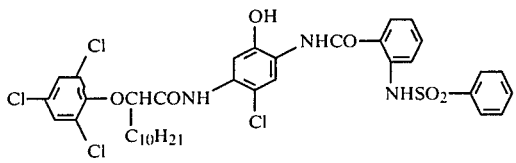

(I-44)

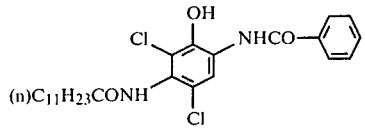

(I-45)

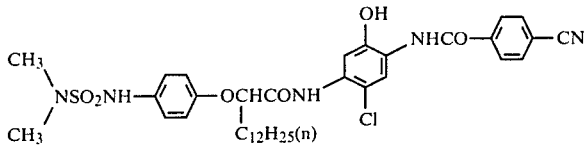

(I-46)

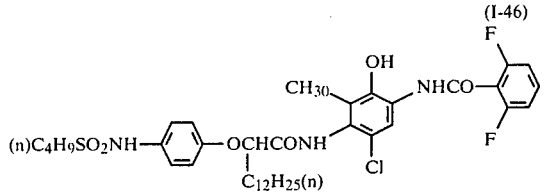

(I-47)

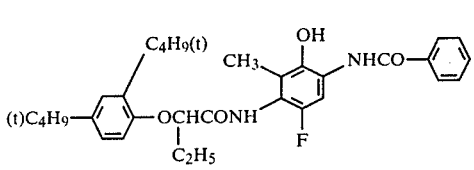

(I-48)

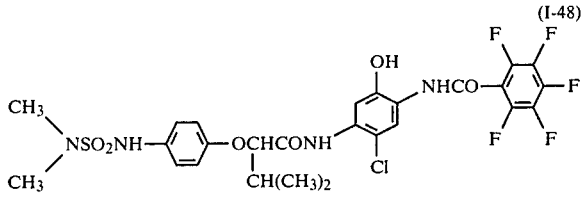

(I-49)

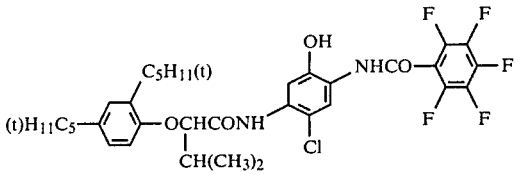

The preferred ones of the alkyl radicals represented by the $R_4$ and $R_5$ of Formula [II] in the present invention are those alkyl radicals having from 1 to 12 carbon atoms, and more preferably those alkyl radicals the $\alpha$ position of which is branched-chain, having from 3 to 8 carbon atoms. The particularly preferred alkyl radical represented by the $R_4$ or $R_5$ is t-butyl or t-pentyl radical.

The alkyl radical represented by the $R_6$ is in the straight-chain or branched-chain form and includes, e.g., methyl, ethyl, propyl, butyl, pentyl, octyl, nonyl, dodecyl, octadecyl, and the like radicals. Should any of these alkyl radicals have a substituent or substituents, those introducible substituents include halogens, hydroxyl radical, nitro radical, cyano radical, aryl radicals (such as phenyl, hydroxyphenyl, 3,5-di-t-butyl-4-hydroxyphenyl, 3,5-di-t-pentyl-4-hydroxyphenyl, etc.), amino radicals (such as dimethylamino, diethylamino, 1,3,5-triazinylamino, (etc.), alkyloxycarbonyl radicals (such as methoxycarbonyl, ethoxycarbonyl, propyloxycarbonyl, butoxycarbonyl, pentyloxycarbonyl, octyloxycarbonyl, nonyloxycarbonyl, dodecyloxycarbonyl, octadecyloxycarbonyl, etc.), aryloxycarbonyl radicals (such as phenoxycarbonyl, etc.), carbamoyl radicals (such alkylcarbamoyl radicals as methylcarbamoyl, ethylcarbamoyl, propylcarbamoyl, butylcarbamoyl, heptylcarbamoyl, etc., such arylcarbamoyl radicals as phenylcarbamoyl, etc., such cycloalkylcarbamoyls as cyclohexylcarbamoyl, etc., and the like), heterocyclic radicals such as isocyanuryl, 1,3,5-triazinyl, and the like. The amino radical represented by the $R_6$ includes, e.g., alkylamino radicals such as dimethylamino, diethylamino, methyl-ethylamino, etc., arylamino radicals such as phenylamino, hydroxylphenylamino, etc., cycloalkylamino radicals such as cyclohexylamino, etc., heterocyclic amino radicals such as 1,3,5-triazinylamino, isocyanuryl, etc., and the like. The monovalent organic radicals represented by the $R_6'$ and $R_6''$ include, e.g., alkyl radicals (such as methyl, ethyl, propyl, butyl, amyl, decyl, dodecyl, hexadecyl, octadecyl, etc.), aryl radicals (such as pheny, naphthyl, etc.), cycloalkyl radicals (such as cyclohexyl, etc.), heterocyclic radicals (such as 1,3,5-triazinyl, isocyanuryl, etc.), and the like. Should any of these organic radicals have a substituent or substituents, those introducible substituents includes, e.g., halogens (such as fluorine, chlorine, bromine, etc.), hydroxyl radical, nitro radical, cyano radical, amino radical, alkyl radicals (such as methyl, ethyl, i-propyl, t-butyl, t-amyl, etc.), aryl radicals (such as phenyl, tolyl, etc.), alkenyl radicals (such as allyl, etc.), alkylcarbonyloxy radicals (such as methylcarbonyloxy, ethylcarbonyloxy, benzylcarbonyloxy, etc.), arylcarbonyloxy (such as benzoyloxy, etc.), and the like.

In the present invention, the preferred ones of the compounds having Formula [II] are those compounds having the following Formula [V]:

Formula [V]

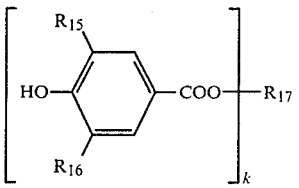

wherein $R_{15}$ and $R_{16}$ each is a straight-chain or branched-chain alkyl radical having from 3 to 8 carbon atoms, such as particularly t-butyl or t-pentyl; $R_{17}$ is a k-valent organic radical; and k is an integer of from 1 to 6.

The k-valent organic radical represented by the $R_{17}$ includes, e.g., alkyl radicals such as methyl, ethyl, propyl, butyl, pentyl, octyl, hexadecyl, methoxyethyl, chloromethyl, 1,2-dibromoethyl, 2-chloroethyl, benzyl, phenetyl, etc.; alkenyl radicals such as allyl, propenyl, butenyl, etc.; multivalent unsaturated hydrocarbon radicals such as ethylene, trimethylene, propylene, hexamethylene, 2-chlorotrimethylene, etc.; unsaturated hydrocarbon radicals such as glyceryl, diglyceryl, pentaerythrityl, dipentaerythrityl, etc.; alicyclic hydrocarbon radicals such as cyclopropyl, cyclohexyl, cyclohexenyl, etc.; aryl radicals such as phenyl, p-octylphenyl, 2,4-dimethylphenyl, 2,4-di-t-butylphenyl, 2,4-di-t-pentylphenyl, p-chlorophenyl, 2,4-dibromophenyl, naphthyl, etc.; arylene radicals such as 1,2-, 1,3- or 1,4-phenylene, 3,5-dimethyl-1,4-phenylene, 2-t-butyl-1,4-phenylene, 2-chloro-1,4-phenylene, naphthalene, etc.; 1,3,5-trisubstituted benzene radicals; and the like.

The $R_{17}$ aside from the above radicals, further includes other k-valent organic radicals which combine through such a radical as —O—, —S—, or —$SO_2$—.

The more preferred radicals as the $R_{17}$ are 2,4-di-t-butylphenyl, 2,4-di-t-pentylphenyl, p-octylphenyl, p-dodecylphenyl, 3,5-di-t-butyl-4-hydroxylphenyl and 3,5-di-t-pentyl-4-hydroxylphenyl radicals.

The k is an integer of preferably from 1 to 4.

The following are typical examples of the compounds having Formula [II], but the compounds are not limited to the following examples:

(II-1)

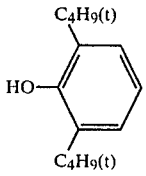

(II-2)

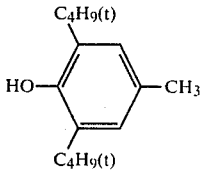

(II-3)

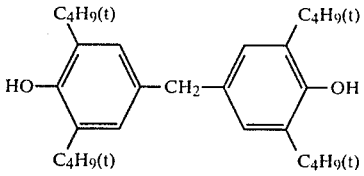

-continued (II-4)

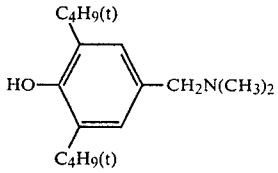

(II-5)

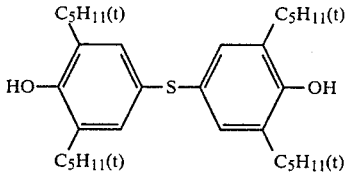

(II-6)

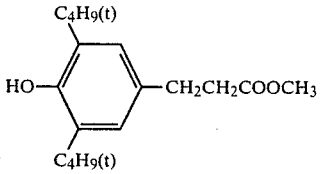

(II-7)

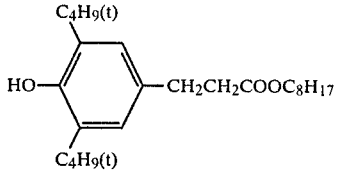

(II-8)

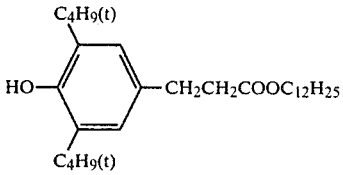

(II-9)

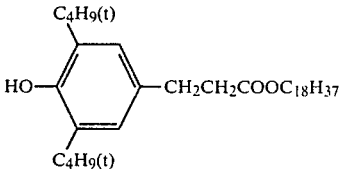

(II-10)

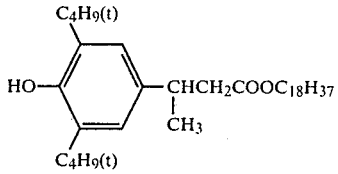

(II-11)

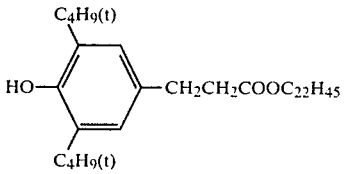

(II-12)

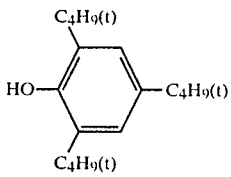

-continued
(II-13)
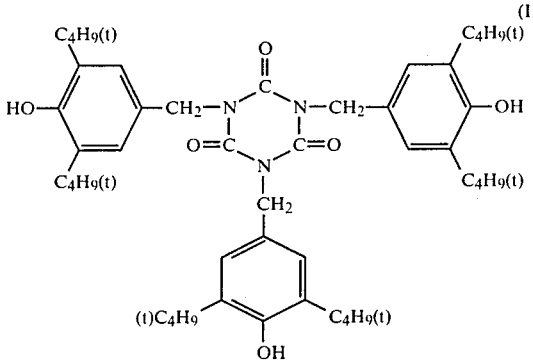
(II-14)
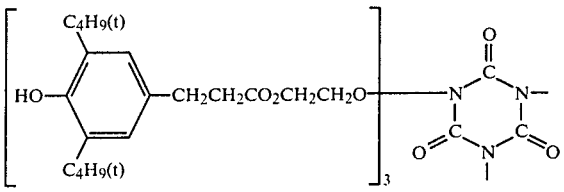
(II-15)
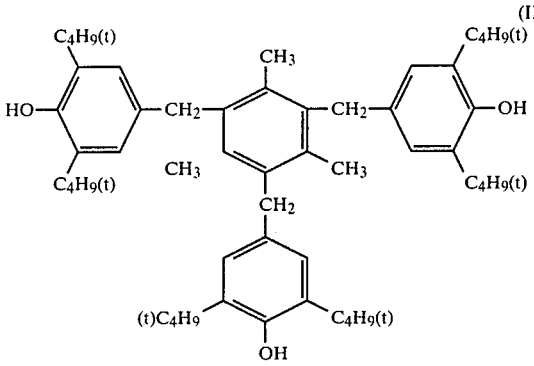
(II-16)
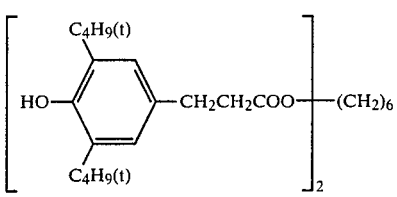
(II-17)
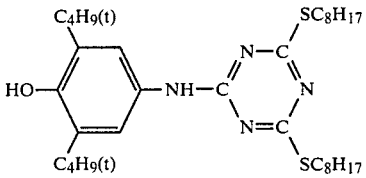
(II-18)
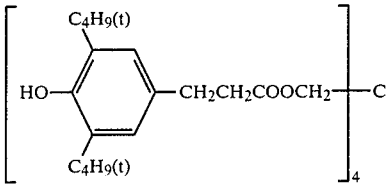
-continued
(II-19)
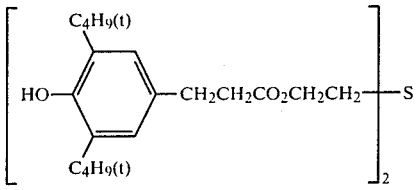
(II-20)
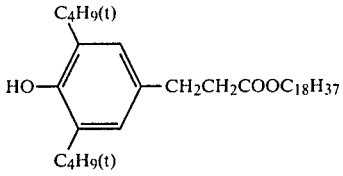
(II-21)
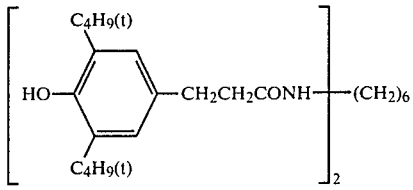
(II-22)
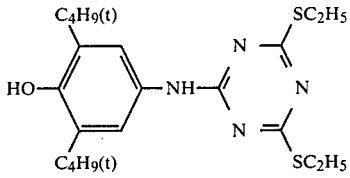
(II-23)
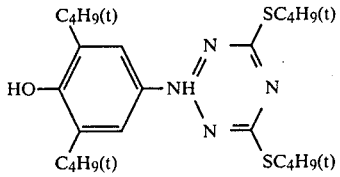
(II-24)
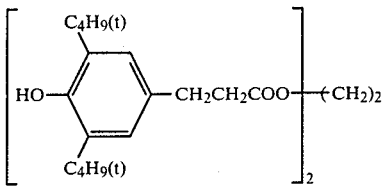
(II-25)
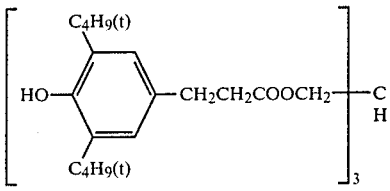
(II-26)
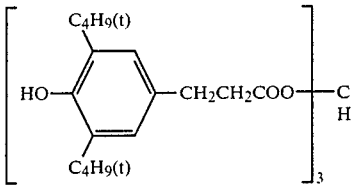

-continued
(II-27)
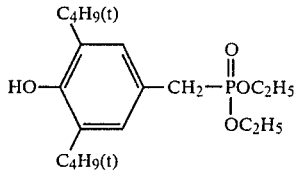
(II-28)
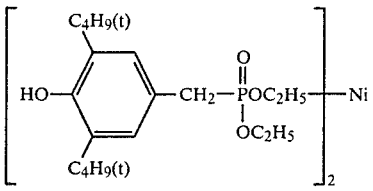
(II-29)
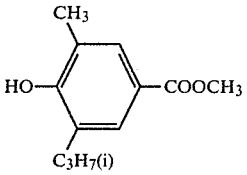
(II-30)
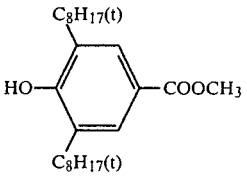
(II-31)
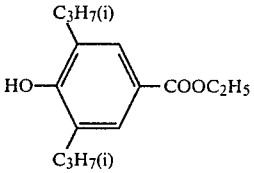
(II-32)
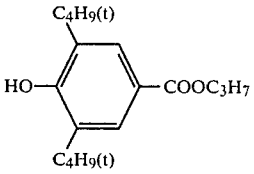
(II-33)
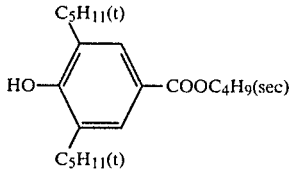
(II-34)
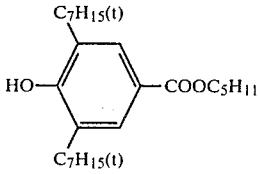
(II-35)
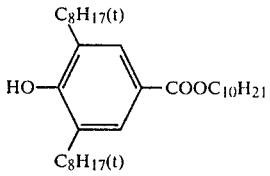
-continued
(II-36)
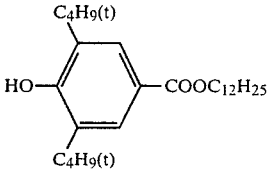
(II-37)
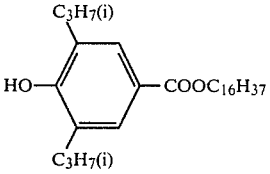
(II-38)
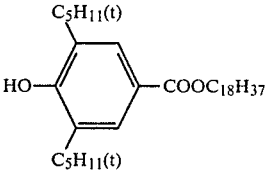
(II-39)
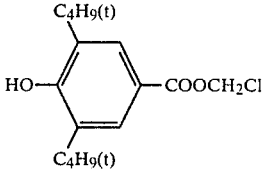
(II-40)
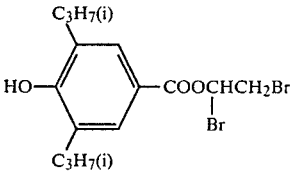
(II-41)
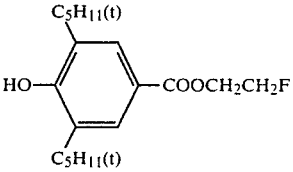
(II-42)
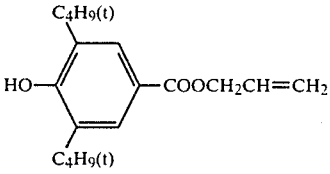
(II-43)
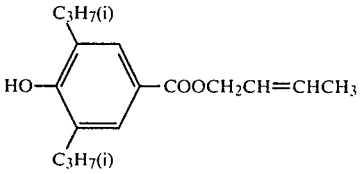
(II-44)
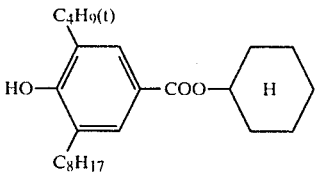

-continued
(II-45)
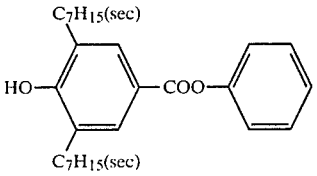
(II-46)
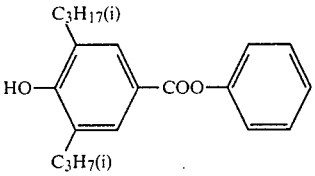
(II-47)
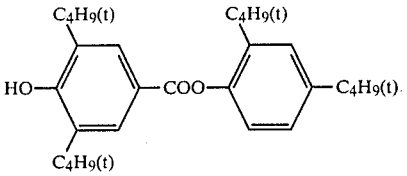
(II-48)
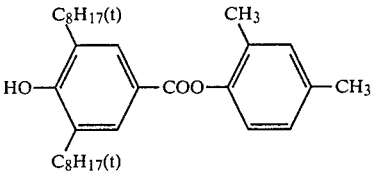
(II-49)
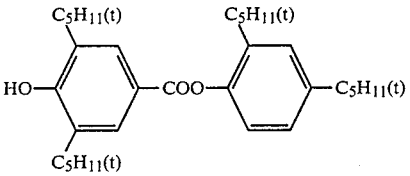
(II-50)
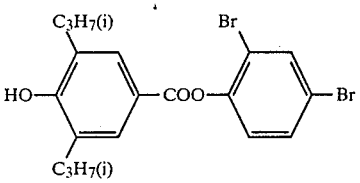
(II-51)
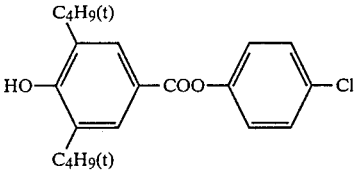
(II-52)
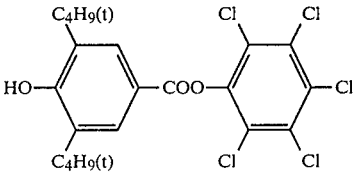
(II-53)
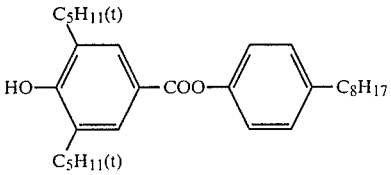
-continued
(II-54)
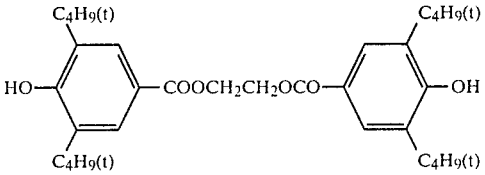
(II-55)
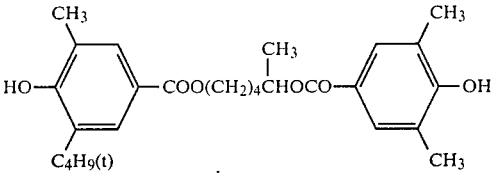
(II-56)
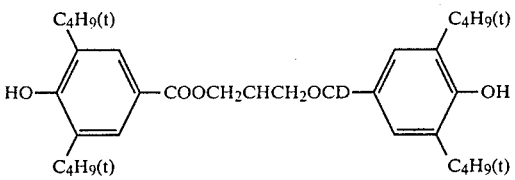
(II-57)
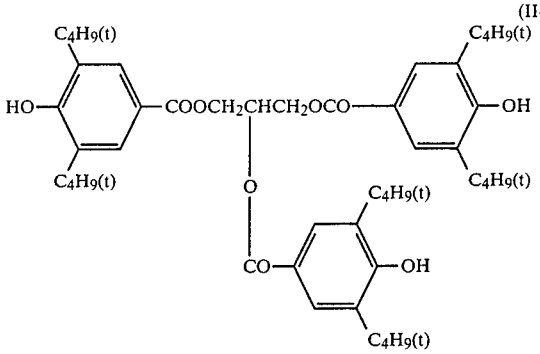
(II-58)
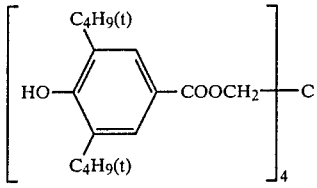
(II-59)
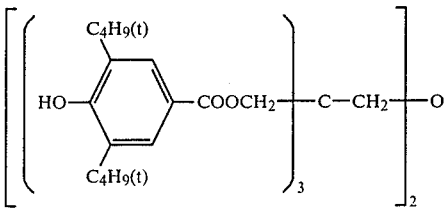
(II-60)
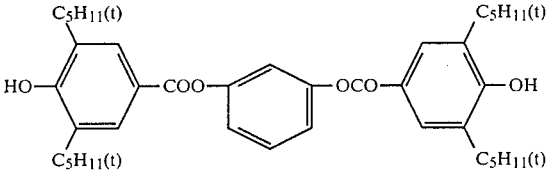

-continued
(II-61)
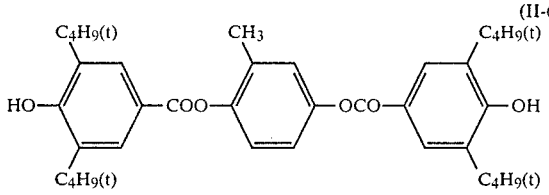
(II-62)
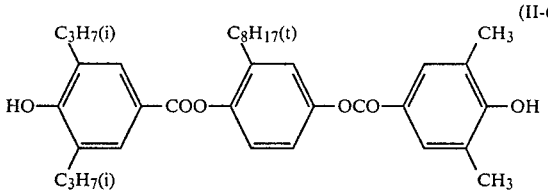
(II-63)
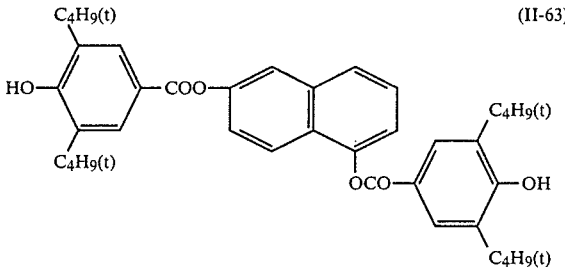
(II-64)
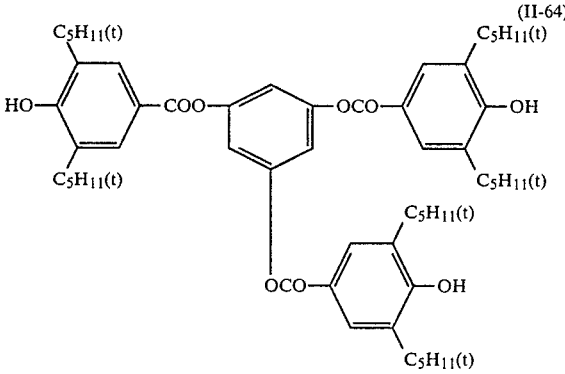
(II-65)
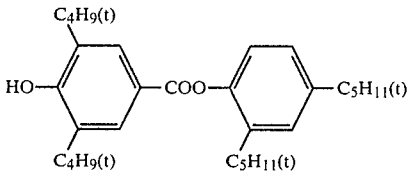
(II-66)
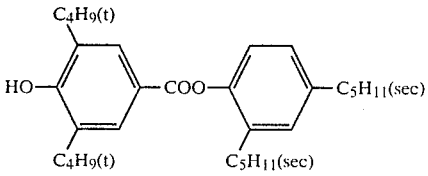
(II-67)
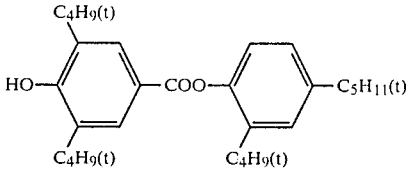
-continued
(II-68)
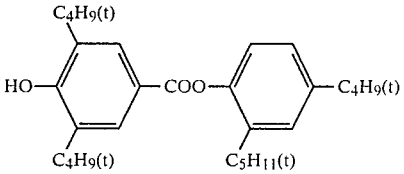
(II-69)
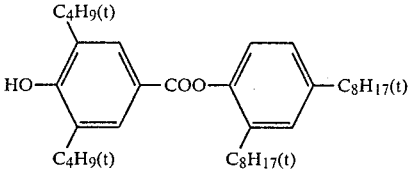
(II-70)
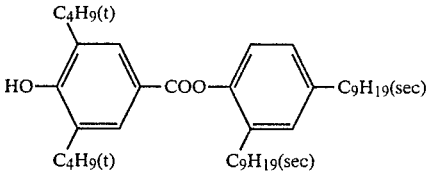
(II-71)
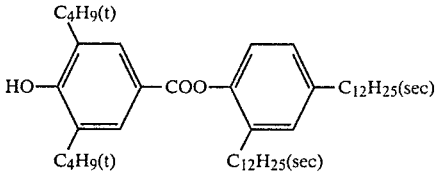
(II-72)
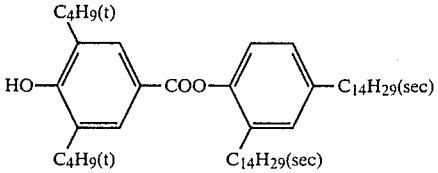
(II-73)
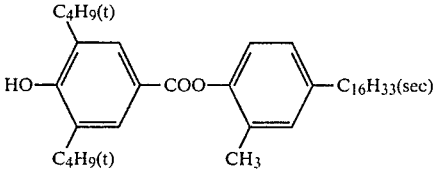
(II-74)
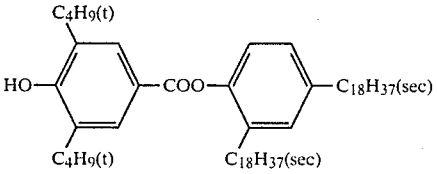
(II-75)
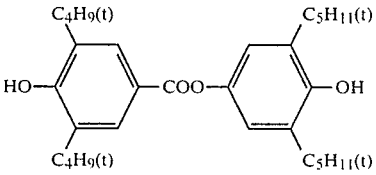
(II-76)
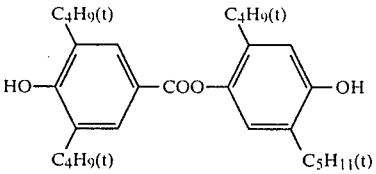

-continued (II-77)

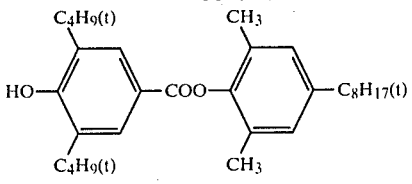

(II-78)

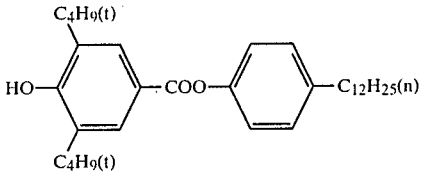

(II-79)

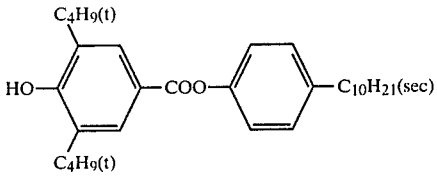

(II-80)

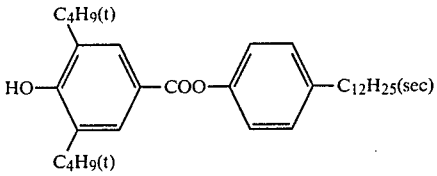

(II-81)

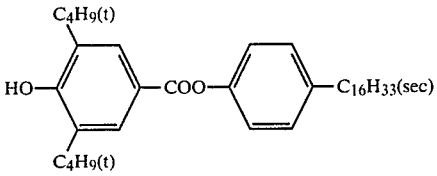

(II-82)

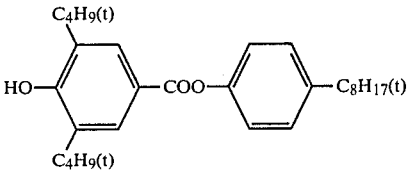

(II-83)

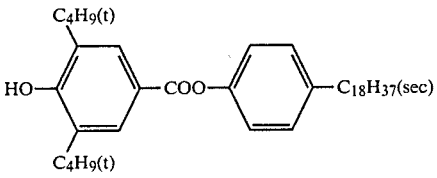

(II-84)

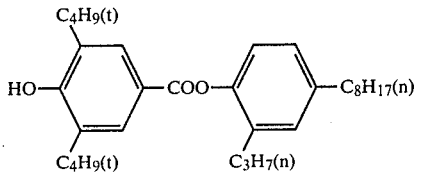

(II-85)

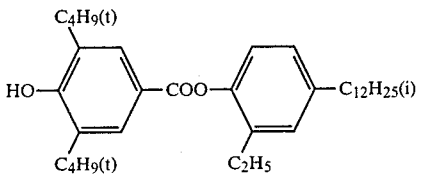

-continued (II-86)

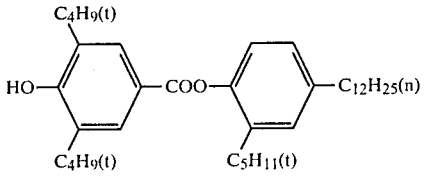

(II-87)

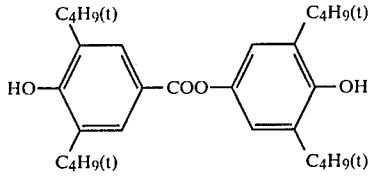

(II-88)

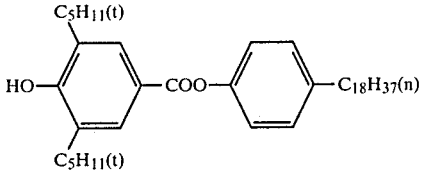

(II-89)

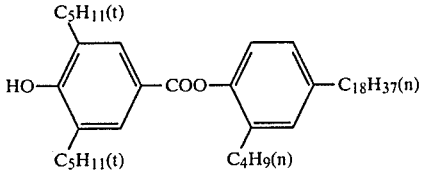

(II-90)

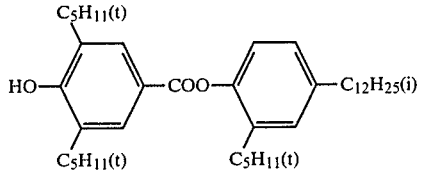

In the present invention, the alkyl radical represented by the $R_7$ of Formula [III] has from 1 to 12 carbon atoms; the alkenyl or alkinyl radical has from 2 to 4 carbon atoms; and the monovalent organic radical represented by the $R_7'$, $R_7''$ or $R_7'''$ is, e.g., an alkyl radical, an alkenyl radical, an alkinyl radical, an aryl radical, or the like. The preferred radicals represented by the $R_7$ includes hydrogen, alkyl radicals (such as methyl, ethyl, propyl, butyl, chloromethyl, hydroxymethyl, benzyl, etc.), alkenyl radicals (such as vinyl, allyl, isopropenyl, etc.), alkinyl radicals (such as thienyl, propinyl, etc.), and —$COR_7'''$, wherein $R_7'''$ is, e.g., an alkyl radical (such as methyl, ethyl, propyl, butyl, benzyl, etc.), an alkenyl radical (such as vinyl, allyl, isopropenyl, etc.), an alkinyl radical (such as thienyl, propinyl, etc.), an aryl radical (such as pheny, tolyl, etc.), or the like.

The preferred ones of the alkyl radicals represented by the $R_8$ are those straight-chain or branched-chain alkyl radicals having from 1 to 5 carbon atoms, and the most preferred one of these radicals is methyl radical.

The monovalent organic radical represented by the R' of the radical as the $R_9$ or $R_{10}$ is, e.g., an alkyl radical (such as methyl, ethyl, propyl, butyl, pentyl, octyl, dodecyl, octadecyl, etc.), an alkenyl radical (such as vinyl, etc.), an alkinyl radical (such as thienyl), an aryl radical (such as phenyl, naphthyl, etc.), an alkylamino radical (such as ethylamino, etc.), an arylamino radical (such as anilino, etc.), and the like. The heterocylic radical formed by the $R_9$ and $R_{10}$ together is such as, for example,

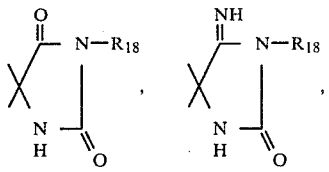

or the like, wherein $R_{18}$ is a hydrogen atom, an alkyl radical, a cycloalkyl radical or a phenyl radical.

In the present invention, the preferred ones of the compounds having Formula [III] are those having the following Formula [VI]:

Formula [VI]

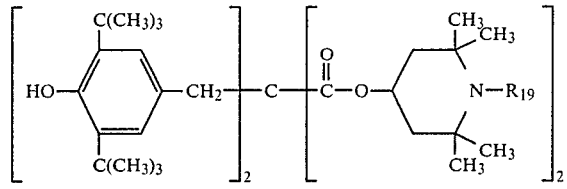

wherein $R_{19}$ is an alkyl radical (such as methyl, ethyl, propyl, butyl, pentyl, benzyl, etc.), an alkenyl radical (such as vinyl, allyl, isopropenyl, etc.), an alkinyl radical (such as thienyl, propinyl, etc.), an acyl radical (such as formyl, acetyl, propionyl, butyryl, acryloyl, propioloyl, methacryloyl, crotonoyl, etc.). The more preferred radicals as the $R_{19}$ include methyl, ethyl, vinyl, allyl, propinyl, benzyl, acetyl, propionyl, acryloyl, methacryloyl, and crotonoyl radicals.

The following are typical examples of the compounds having Formula [III], but the compounds are not limited thereto.

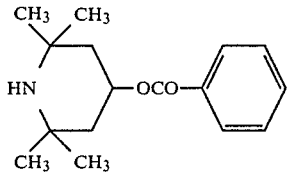

(III-1)

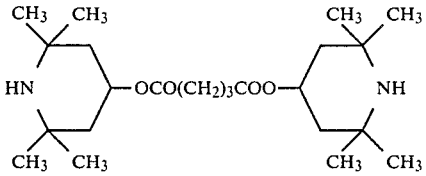

(III-2)

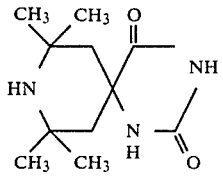

(III-3)

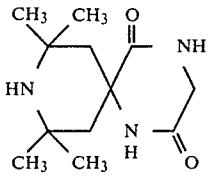

(III-4)

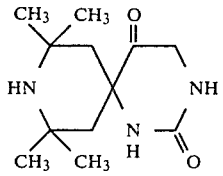

(III-5)

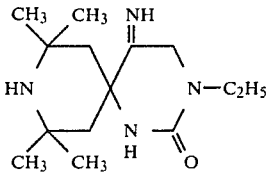

(III-6)

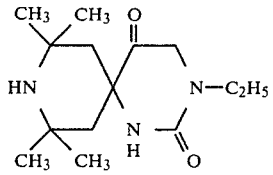

(III-7)

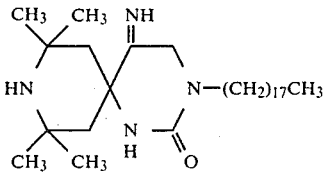

(III-8)

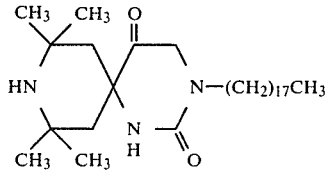

(III-9)

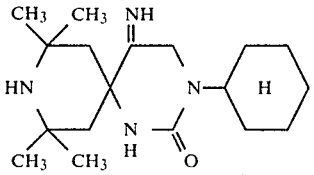

(III-10)

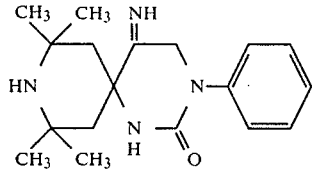

(III-11)

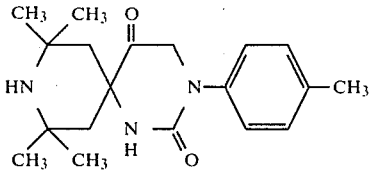

(III-12)

-continued
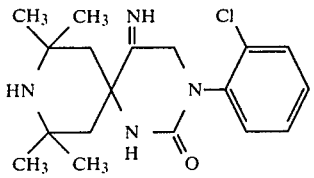
(III-13)
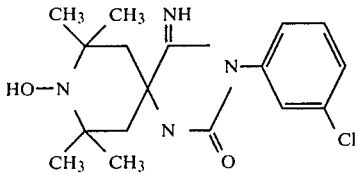
(III-14)
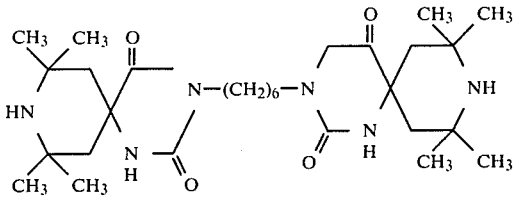
(III-15)
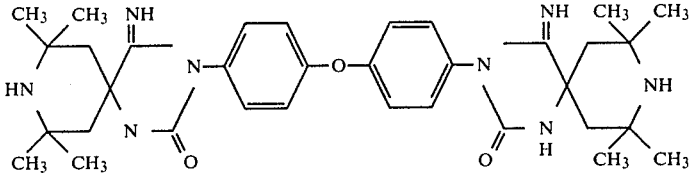
(III-16)
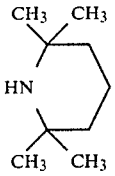
(III-17)
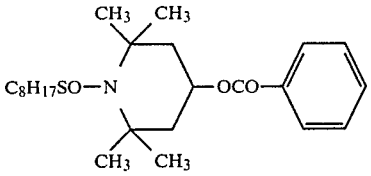
(III-18)
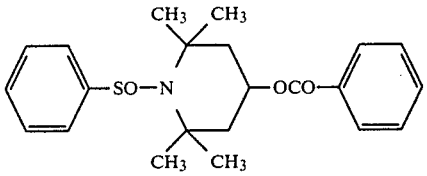
(III-19)
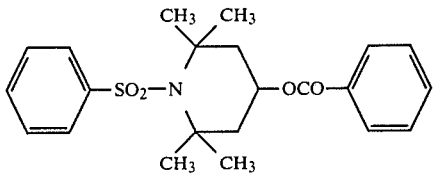
(III-20)
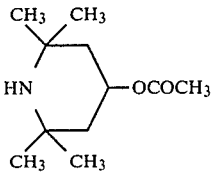
(III-21)
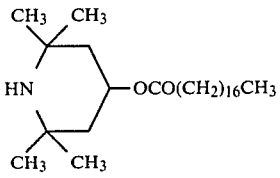
(III-22)
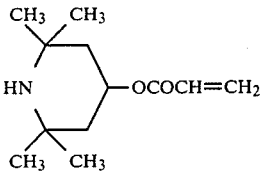
(III-23)
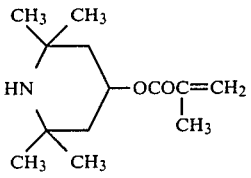
(III-24)
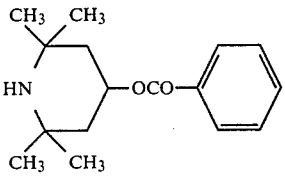
(III-25)
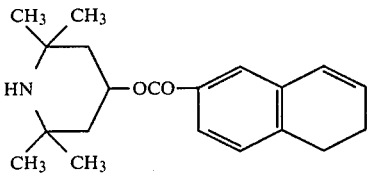
(III-26)
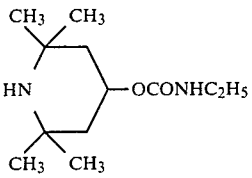
(III-27)
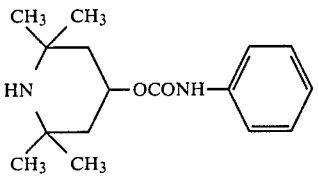
(III-28)

-continued
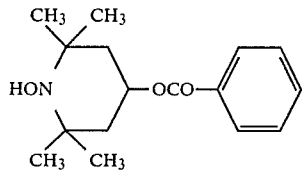
(III-29)
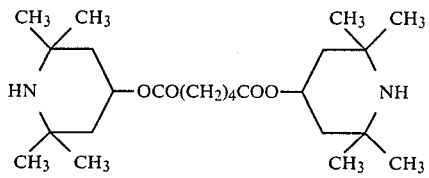
(III-30)
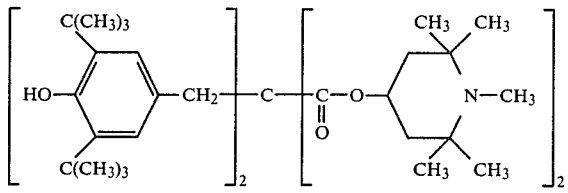
(III-31)
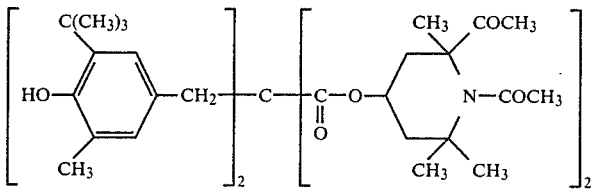
(III-32)
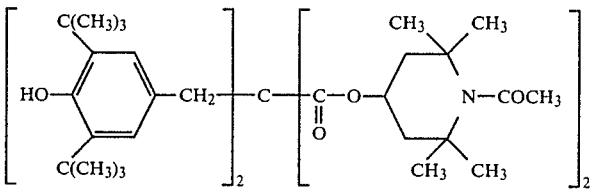
(III-33)
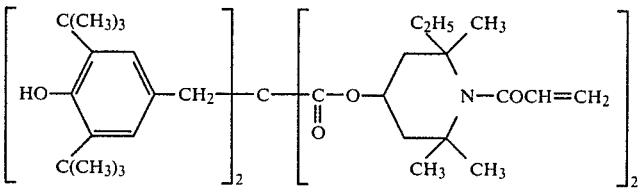
(III-34)
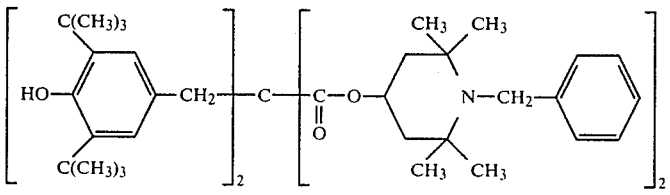
(III-35)
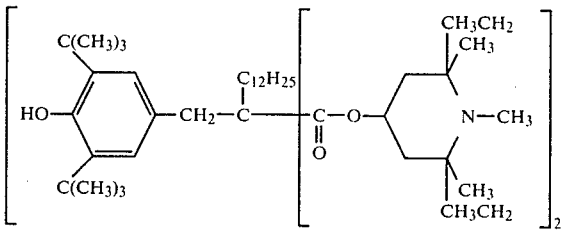
(III-36)

-continued
(III-37)
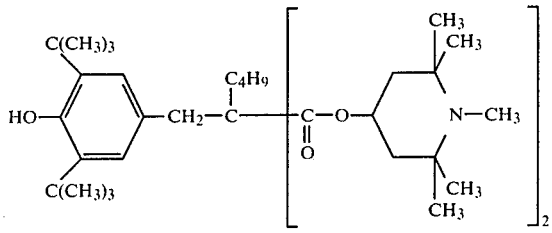
(III-38)
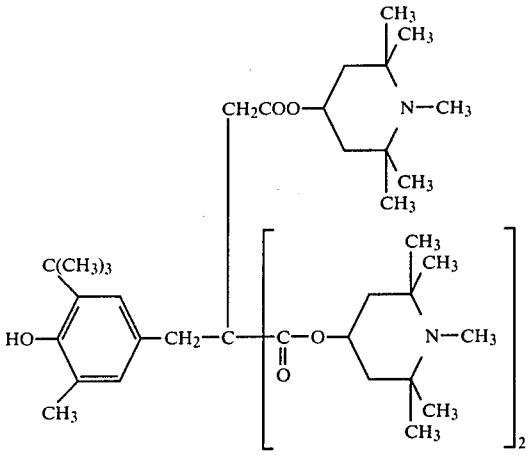
(III-39)
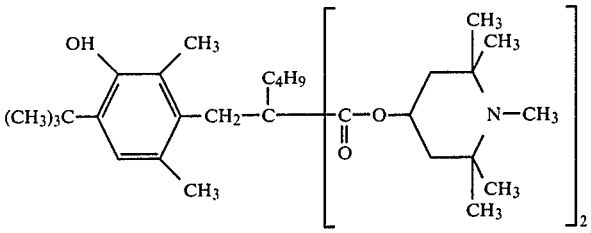
(III-40)
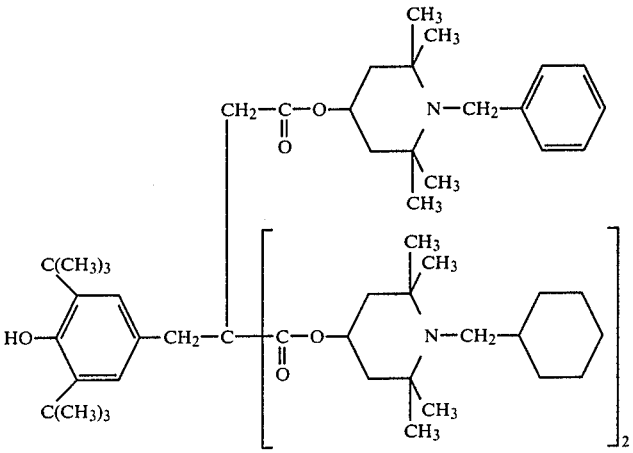
(III-41)
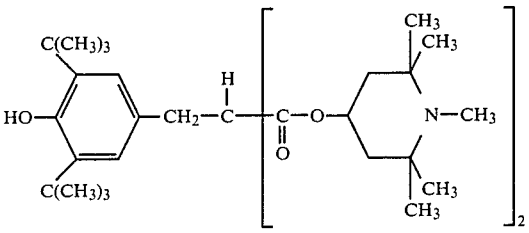

-continued
(III-42)
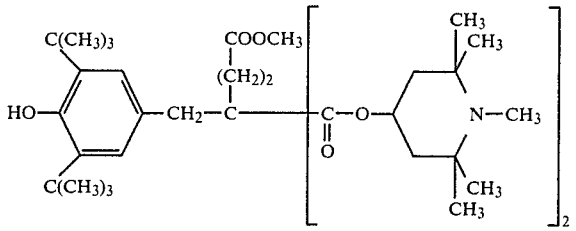
(III-43)
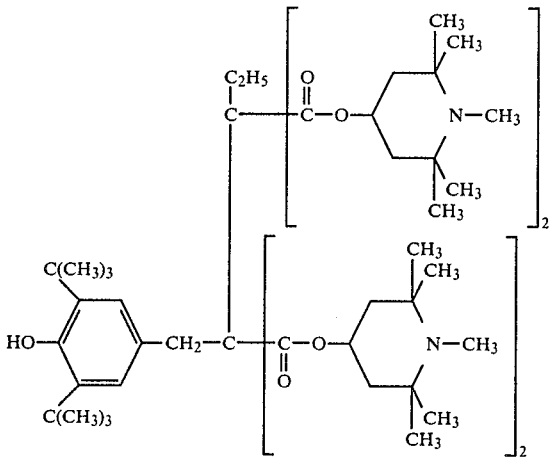
(III-44)
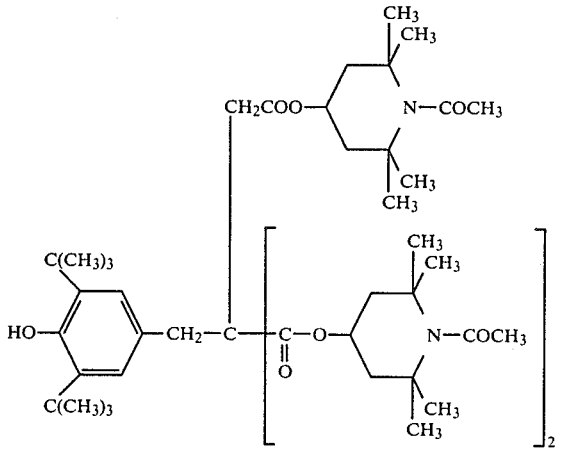
(III-45)
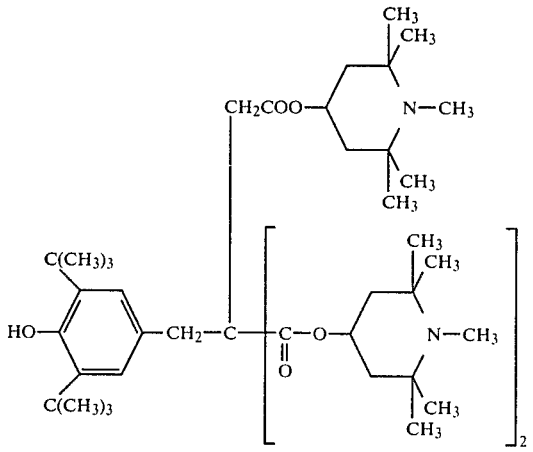

-continued
(III-46)
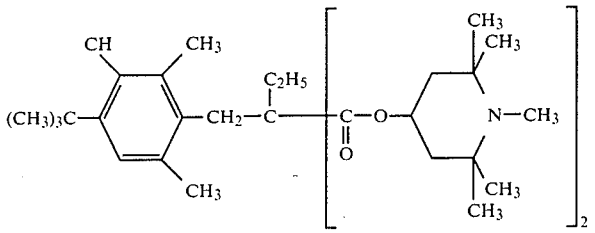
(III-47)
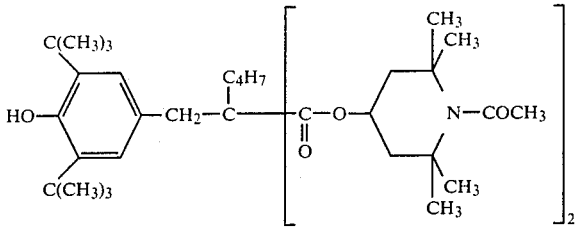
(III-48)
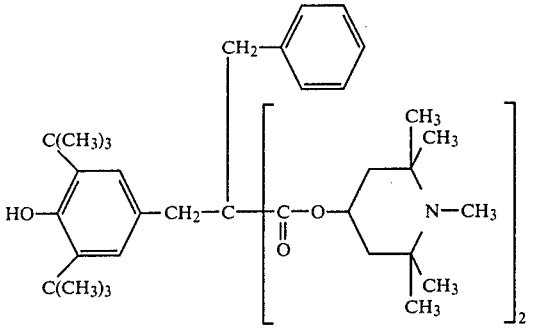
(III-49)
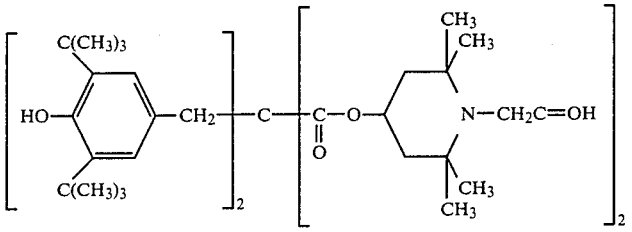
(III-50)
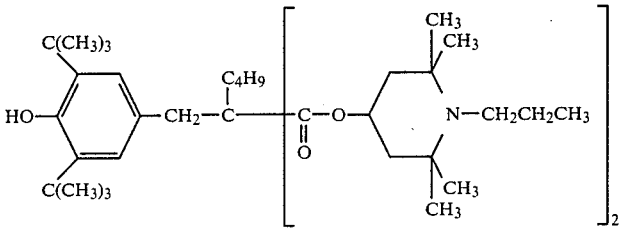
(III-51)
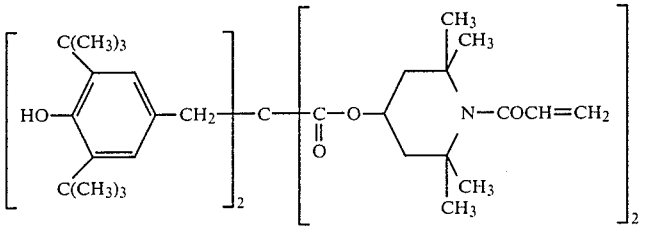

-continued
(III-52)
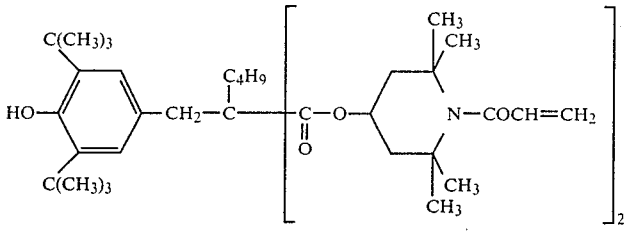
(III-53)
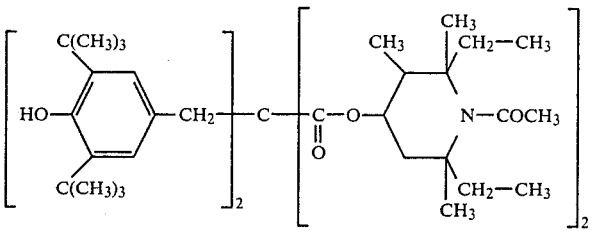
(III-54)
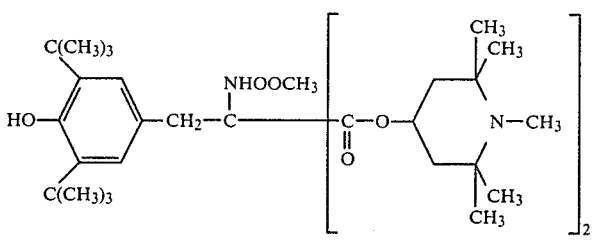
(III-55)
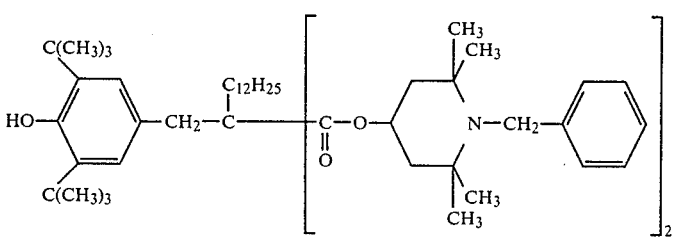
(III-56)
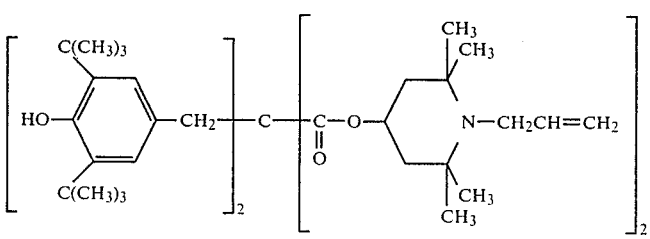
(III-57)
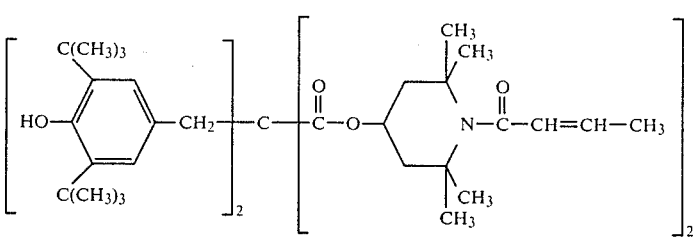

-continued (III-58)

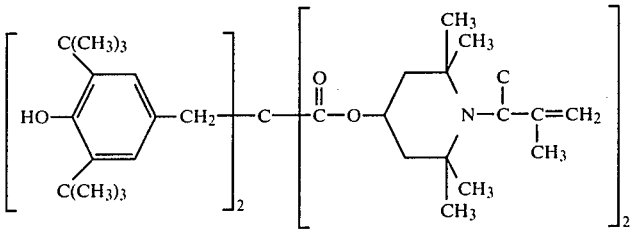

(III-59)

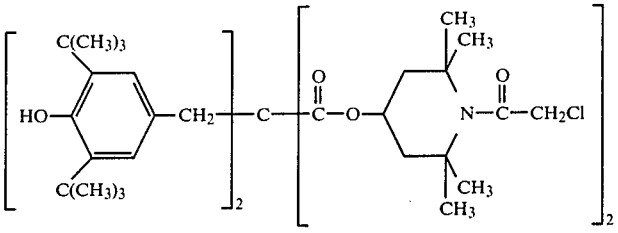

When incorporating any of these compounds having Formula [II] or Formula [III] into the silver halide emulsion layer, the adding quantity thereof is preferably from 5 to 300 parts by weight, and more preferably from 10 to 100 parts by weight per 100 parts by weight of the cyan coupler having Formula [I] of the present invention.

The silver halide photographic light-sensitive material of the present invention may be of any type if it comprises a support having thereon at least one silver halide emulsion layer, and no special restrictions are placed on the number and order of the silver halide emulsion layers and nonlight-sensitive layers coated on the support. Typical examples of such the silver halide photographic light-sensitive material include color positive or negative film, color photographic printing paper, color slides, such special photographic light-sensitive materials as for graphic arts use, for radiography use and for high-resolution application use, and the like, and the photographic light-sensitive material is particularly suitably usable as color photographic printing paper. The foregoing silver halide emulsion layers and nonlight-sensitive layers are usually mostly hydrophilic colloidal layers containing a hydrophilic binder. As the hydrophilic binder there may be used gelain or gelatin derivatives such as acylated gelatin, guanidylated gelatin, carbamylated gelatin, cyanoethanolated gelatin, esterified gelatin, and the like.

The cyan coupler having Formula [I] of the present invention (hereinafter referred to as the cyan coupler of the invention) may be incorporated into a silver halide emulsion by a method that is applied to ordinary cyan dye-forming couplers, and the emulsion is coated to be layered on a support, thereby forming a photographic element. The photographic element may be either a monochromatic element or a multicolor element. In the case of a multicolor element, the cyan coupler of the invention is usually incorporated into a red-sensitive silver halide emulsion layer, but may also be incorporated into a nonlight-sensitive emulsion layer or into non-red-sensitive emulsion layers that are sensitive to the spectral regions of red-excluded threen primary colors. Each of the respective dye image-forming component units in the present invention is either a single emulsion layer or a plurality of emulsion layers which are sensitive to a specific spectral region.

The incorporation of the cyan coupler of the invention may be carried out by any of those methods of the prior art. For example, cyan couplers of the present invention may be singly or in a mixture thereof dissolved separately into a single high-boiling organic solvent such as a phthalate (e.g., dibutyl phthalate, etc.), a phosphate (e.g., tricresyl phosphate, etc.), or an N,N-dialkyl-substituted amide (e.g., N,N-diethyl-laurylamide, etc.) and a single low-boiling organic solvent such as butyl acetate or butyl propionate, or, if necessary, into a mixture of both solvents, and the resulting solution is then mixed with an aqueous gelatin solution containing a surfactant. After that the mixture is emulsified to be dispersed by use of a high-speed rotary mixer, colloid mill, or ultrasonic disperser, and the dispersed liquid is then added to a silver halide to thereby prepare a silver halide emulsion to be used in the present invention.

The cyan coupler of the invention may be incorporated into the silver halide emulsion in a quantity of usually from about 0.05 mole to 2 moles, and preferably from 0.1 mole to 1 mole per mole of silver halide.

In the case where the silver halide color photographic light-sensitive material of the present invention is a multicolor element, the necessary layers for the photographic element, including the above image forming component-unit layers, may be provided in various orders as known to those skilled in the art. A typical multicolor photographic element comprises a support having thereon a cyan dye image-formable component unit comprising at least one red-sensitive silver halide emulsion layer containing cyan dye-forming couplers (at least one of the cyan couplers is the cyan coupler of the invention having Formula [I]); a magenta dye image-formable component unit comprising at least one green-sensitive silver halide emulsion layer containing at least one magenta dye-forming coupler; and an yellow dye image-formable component unit comprising at least one blue-sensitive silver halide emulsion layer containing at least one yellow dye-forming coupler.

The photographic element may also have such additional nonlight-sensitive layers as, for example, filter layers, interlayers, a protective layer, an antihalation layer, a subbing layer, and the like.

As the yellow dye-forming coupler usable in the present invention, those compounds having the following Formula [VII] are preferred:

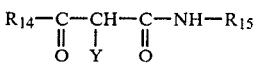

Formula [VII]

wherein $R_{14}$ is an alkyl radical (such as methyl, ethyl, propyl, butyl, etc.) or an aryl radical (such as phenyl, P-methoxyphenyl, etc.); $R_{15}$ is an aryl radical; and Y is a hydrogen atom or a radical that can be split off during the course of a color developing reaction.

Further, as the yellow dye image-forming yellow coupler in the present invention, the particularly preferred are those compounds having the following Formula [VII']

Formula [VII']

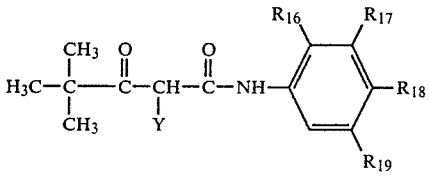

wherein $R_{16}$ is a halogen atom, an alkoxy radical or an aryloxy radical; $R_{17}$, $R_{18}$ and $R_{19}$ each is a hydrogen atom, a halogen atom, an alkyl radical, an alkenyl radical, an alkoxy radical, an aryl radical, an aryloxy radical, a carbonyl radical, a sulfonyl radical, a carboxyl radical, an alkoxycarbonyl radical, a carbamyl radical, a sulfone radical, a sulfamyl radical, a sulfonamido radical, an acylamido radical, an ureido radical or an amino radical; and Y is as defined previously.

These are as described in, e.g., U.S. Pat. Nos. 2,778,658, 1,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875; West German OLS Patent Nos. 1,547,868, 2,057,941, 2,162,899, 2,163,812, 2,213,461, 2,219,917, 2,261,361, and 2,263,875; Japanese Patent Examined Publication No. 13576/1974; and Japanese Patent O.P.I. Publication Nos. 29432/1973, 66834/1973, 10736/1974, 122335/1974, 28834/1975 and 132926/1975.

As the magenta dye image-forming coupler, those couplers having the following Formula [VIII] may be suitably used:

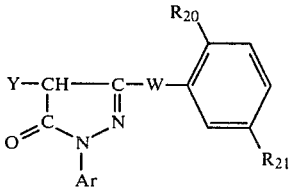

Formula [VIII]

wherein Ar is an aryl radical; $R_{20}$ is a hydrogen atom, a halogen atom, an alkyl radical or an alkoxy radical; $R_{21}$ is an alkyl radical, an amido radical, an imido radical, an N-alkylcarbamoyl radical, an N-alkylsulfamoyl radical, an alkoxycarbonyl radical, an acyloxy radical, a sulfonamido radical or an ureido radical; Y is as defined in Formula [V]; and W is —NH—, —NHCO— (wherein the N atom is bonded with the carbon atom of the pyrazolone nucleus) or —NHCONH—.

These are as described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Patent O.P.I. Publication Nos. 29639/1974, 111631/1974, 129538/1974, 13041/1975, 58922/1977, 62454/1980, 118034/1980 and 38034/1981; British Pat. No. 1,247,493; Belgian Pat. Nos. 769,116 and 792,525; West German Pat. No. 2,156,111; and Japanese Patent Examined Publication No. 60479/1971. The following are typical examples of the yellow and magenta dye-forming couplers suitably usable in the present invention, but the couplers are not limited thereto. Yellow couplers:

Y-1: α-benzoyl-2-chloro-5-[α-(dodecyloxycarbonyl)-ethoxycarbonyl]-acetanilide.

Y-2: α-benzoyl-2-chloro-5-[γ-(2,4-di-t-amylphenoxy)-butylamido]acetanilide

Y-3: α-fluoro-α-pivalyl-2-chloro-5-[γ-(2,4-di-t-amylphenoxy)-butylamido]-acetanilide.

Y-4: α-pivalyl-α-stearoyloxy-4-sulfamoyl-acetanilide.

Y-5: α-pivalyl-α-[4-(4-benzyloxyphenylsulfonyl)-phenoxy]-2-chloro-5-[γ-(2,4-di-t-amylphenoxy)-butylamido]-acetanilide.

Y-6: α-(2-methoxybenzoyl)-α-(4-acetoxyphenoxy)-4-chloro-2-(4-t-octylphenoxy)-acetanilide.

Y-7: α-pivalyl-α-(3,3-dipropyl-2,4-dioxo-acetidin-1-yl)-2-chloro-5-[α-(dodecyloxycarbonyl)-ethoxycarbonyl]-acetanilide.

Y-8: α-pivalyl-α-succinimido-2-chloro-5-[γ-(2,4-di-t-amylphenoxy)butylamido]-acetanilide.

Y-9: α-pivalyl-α-(3-tetradecyl-1-succinimido)-acetanilide.

Y-10: Dipotassium α-(4-dodecyloxybenzoyl)-α-(3-methoxy-1-succinimido)-3,5-dicarboxyacetanilide.

Y-11: α-pivalyl-α-phthalimido-2-chloro-5-[γ-(2,4-di-t-amylphenoxy)butylamido]-acetanilide.

Y-12: α-2-furyl-α-phthalimido-2-chloro-5-[γ-(2,4-di-t-amylphenoxy)butylamido]-acetanilide.

Y-13: α-3-[α-(2,4-di-t-amylphenoxy)butylamido]-benzoyl-α-succinimido-2-methoxyacetanilide.

Y-14: α-phthalimido-α-pivalyl-2-methoxy-4-[(N-methyl-N-octadecyl)-sulfamoyl]-acetanilide.

Y-15: α-acetyl-α-succinimido-2-methoxy-4-[(N-methyl-N-octadecyl)sulfamoyl]-acetanilide.

Y-16: α-cyclobutyryl-α-(3-methyl-3-ethyl-1-succinimido)-2-chloro-5-[(2,5-di-t-amylphenoxy)acetamido]-acetanilide.

Y-17: α-(3-octadecyl-1-succinimido)-α-propenoyl-acetanilide.

Y-18: α-(2,6-di-oxo-3-n-propyl-piperidine-1-yl)-α-pivalyl-2-chloro-5-[γ-(2,4-di-t-amylphenoxy)butylcarbamoyl]-acetanilide.

Y-19: α-(1-benzyl-2,4-dioxo-imidazolidine-3-yl)-α-pivalyl-2-chloro-5-[γ-(2,4-di-t-amylphenoxy)butylamido]-acetanilide.

Y-20: α-(1-benzyl-2-phenyl-3,5-dioxo-1,2,4-triazine-4-yl)-α-pivalyl-2-chloro-5-[γ-(2,4-di-t-amylphenoxy)-butylamido]-acetanilide.

Y-21: α-(3,3-dimethyl-1-succinimido)-α-pivalyl-2-chloro-5-[α-(2,4-di-t-amylphenoxy)butylamido]-acetanilide.

Y-22: α-[3-(p-chlorophenyl)-4,4-dimethyl-2,5-dioxo-1-imidazolyl]-α-pivalyl-2-chloro-5-[γ-(2,4-di-t-amylphenoxy)butylamido]-acetanilide.

Y-23: α-pivalyl-α-(2,5-dioxo-1,3,4-triazine-1-yl)-2-methoxy-5-[α-(2,4-di-t-amylphenoxy)butylamido]-acetanilide.

Y-24: α-(5-benzyl-e,4-dioxo-3-oxazoyl)-α-pivalyl-2-chloro-5-[γ-(2,4-di-t-amylphenoxy)butylamido]-acetanilide.

Y-25: α-(5,5-dimethyl-2,4-dioxo-3-oxazoyl)-α-pivalyl-2-chloro-5-[α-(2,4-di-t-amylphenoxy)butylamido]-acetanilide.

Y-26: α-(3,5-dioxo-4-oxazinyl)-α-pivalyl-2-chloro-5-[γ-(2,4-di-t-amylphenoxy)-butylamido]-acetanilide.

Y-27: α-pivalyl-α-(2,4-dioxo-5-methyl-3-thiazolyl)-2-chloro-5-[γ-(2,4-di-t-amylphenoxy)butylamido]-acetanilide.

Y-28: α-[3(2H)-pyridazone-2-yl]-α-pivalyl-2-chloro-5-[γ-(2,4-di-t-amylphenoxy)butylamido]-acetanilide.

Y-29: α-[4,5-dichloro-3(2H)-pyridazone-2-yl]-α-benzoyl-2-chloro-5-[α-(dodecyloxycarbonyl)-ethoxycarbonyl]-acetanilide.

Y-30: α-(1-phenyl-tetrazole-5-oxy)-α-pivalyl-2-chloro-5[γ-(2,4-di-t-amylphenoxy)butylamido]-acetanilide.

Y-31: 4,4-di-(acetacetamino)-3,3-dimethyldiphenylmethane.

Y-32: P,P'-di-(acetacetamino)diphenylmethane.

Magenta Couplers:

M-1: 1-(2,4,6-trichlorophenyl)-3-(2-chloro-5-octadecylcarbamoyl-anilino)-5-pyrazolone.

M-2: 1-(2,4,6-trichlorophenyl)-3-(2-chloro-5-tetradecaneamidoanilino)-5-pyrazolone.

M-3: 1-(2,4,6-trichlorophenyl)-3-(2-chloro-5-γ-(2,4-di-t-amylphenoxy)butylcarbamoyl]-anilino-5-pyrazolone.

M-4: 1-(2,4,6-trichlorophenyl)-4-chloro-3-[2-chloro-5-(2,4-di-t-amylphenoxy)butylcarbamoyl]-anilino-5-pyrazolone.

M-5: 1-(2,4,6-trichlorophenyl)-4-diphenylmethyl-3-[2-chloro-5-(γ-octadecenylsuccinimido)propylsulfamoyl]-anilino-5-pyrazolone.

M-6: 1-(2,4,6-trichlorophenyl)-4-acetoxy-5-(2-chloro-5-tetradecaneamido)-anilino-5-pyrazolone.

M-5: 1-[γ-(3-pentadecylphenoxy)butylamido]-phenyl-3-anilino-4-(1-phenyl-tetrazole-5-thio)-5-pyrazolone.

M-8: 1-(2,4,6-trichlorophenyl)-3-(2-chloro-5-octadecylsuccinimido)-anilino-5-pyrazolone.

M-9: 1-(2,4,6-trichlorophenyl)-3-(2-chloro-5-octadecenylsuccinimido)-anilino-5-pyrazolone.

M-10: 1-(2,4,6-trichlorophenyl)-3-[2-chloro-5-(N-phenyl-N-octylcarbamoyl)]-anilino-5-pyrazolone.

M-11: 1-(2,4,6-trichlorophenyl)-3-[2-chloro-5-(N-butylcarbonyl)pyradinylcarbonyl]-anilino-5-pyrazolone.

M-12: 1-(2,4,6-trichlorophenyl)-3-[2-chloro-5-(2,4-dicarboxy-5-phenylcarbamoyl)-benzylamido]-anilino-5-pyrazolone.

M-13: 1-(2,4,6-trichlorophenyl)-3-(4-tetradecylthiomethylsuccinimido)-anilino-5-pyrazolone.

M-14: 1-(2,4,6-trichlorophenyl)-3-[2-chloro-4-(2-benzofurylcarboxyamido)]-anilino-5-pyrazolone.

M-15: 1-(2,4,6-trichlorophenyl)-3-{2-chloro-4-[γ-(2,2-dimethyl-6-octadecyl-7-hydroxy-chroman-4-yl)propionamido]}-anilino-5-pyrazolone.

M-16: 1-(2,4,6-trichlorophenyl)-3-[2-chloro-5-(3-pentadecylphenyl)phenylcarbonylamido]-anilino-5-pyrazolone.

M-17: 1-(2,4,6-trichlorophenyl)-3-{2-chloro-5-[2-(3-t-butyl-4-hydroxyphenyl)-tetradecaneamido]-anilino}-5-pyrazolone.

M-18: 1-(2,6-dichloro-4-methoxyphenyl)-3-(2-methyl-5-tetradecaneamido)-anilino-5-pyrazolone.

M-19: 4,4'-benzylidenebis[1-(2,4,6-trichlorophenyl)-3-{2-chloro-4-[γ-(2,4-di-t-amylphenoxy)butylamido]-anilino}-5-pyrazolone.

M-20: 4,4'-benzylidenebis[1-(2,3,4,5,6-pentachlorophenyl)-3-2-chloro-5-[γ-(2,4-di-t-amylphenoxy)-butylamido]-anilino-5-pyrazolone.

M-21: 4,4'-(2-chloro)benzylidenebis[1-(2,4,6-trichlorophenyl)-3-(2-chloro-5-dodecylsuccinimido)-anilino-5-pyrazolone].

M-22: 4,4'-benzylidenebis[1-(2-chlorophenyl)-3-(2-methoxy-4-hexadecaneamido)-anilino-5-pyrazolone].

M-23: 4,4'-methylenebis[1-(2,4,6-trichlorophenyl)-3-(2-chloro-5-dodecenylsuccinimido)-anilino-5-pyrazolone)].

M-24: 1-(2,4,6-trichlorophenyl)-3-[3-(2,4-di-t-amylphenoxyacetamido)benzamido]-5-pyrazolone.

M-25: 3-ethoxy-1-4-[α-(3-pentadecylphenoxy)-butylamido]phenyl-5-pyrazolone.

M-26: 1-(2,4,6-trichlorophenyl)-3-[2-chloro-5-{α-(3-t-butyl-4-hydroxy)phenyl}-tetradecaneamido]-anilino-5-pyrazolone.

M-27: 1-(2,4,6-trichlorophenyl)-3-3-nitroanilino-5-pyrazolone.

Any of these yellow dye-forming and magenta dye-forming couplers may be contained in the silver halide emulsion layer in a quantity of from 0.05 mole to 2 moles per mole of silver halide.

As the support for the photographic light-sensitive material of the present invention there may be used, for example, baryta paper, polyethylene-coated paper, polypropylene synthetic paper, transparent support provided thereon with a reflective layer or material, glass plates, cellulose acetate, cellulose nitrate, polyester film such as of polyethylene terephthalate, polyamide film, polycarbonate film, polystyrene film, or the like. These support materials may be arbitrarily selected so as to be adapted to the purpose for which the silver halide photographic light-sensitive material of the present invention is used.

The silver halide emulsion layer and nonlight-sensitive layer used in the present invention may be coated by any of such various coating processes as the dipping coating process, air-doctor coating process, curtain coating process, hopper coating process and the like.

The silver halide usable for the silver halide emulsions in the present invention includes those arbitrarily usable for ordinary silver halide emulsions, such as silver bromide, silver chloride, silver iodobromide, silver chlorobromide, silver chloroiodobromide, and the like. These silver halide particles may be either fine-grained or coarse-grained, and the particle size distribution thereof may also be either wider or narrower.

The crystal of these silver halides' particles may be either regular or twin, and may also be of any arbitrary proportion between the [100] face and [111] face. Further, the crystal structure of these silver halides' particles may be either homogeneous from the inside to outside thereof or heterogeneous between the inside and outside thereof. Furthermore, these silver halides may be either of the type of forming a latent image mainly on the surface of the particles or of the type forming a latent image inside the particles. Still further, these silver halides may be those prepared by any of the neutral method, ammoniacal method, and acid method, or mixed by any of the simultaneously mixing method, sequentially mixing method, inversely mixing method, conversion method, and the like.

The silver halide emulsion used in the present invention may be chemically sensitized by single or combined use of materials including sulfur sensitizers such as, e.g., arylthiocarbamides, thiourea, cystine, etc.; active or inert selenium sensitizers; reduction sensitizers such as stannous salts, polyamides, etc.; noble-metallic sensitizers of such gold sensitizers as, e.g., potassium auricyanate, potassium chloroaurate, 2-aurosulfobenzthiazole-methyl-chloride, water-soluble salts of ruthenium, iridium, etc., ammonium chloropalladate, potassium chloroplatinate, sodium chloropalladite, etc.; and the like.

The silver halide emulsion of the present invention may contain various photographic additives of the prior art, including those photographic additives as described in, e.g., Research Disclosure No. 17643, December 1978.

The silver halide used in the present invention, in order to be rendered sensitive to the necessary wavelength region for a red-sensitive emulsion, may be spectrally sensitized by use of appropriately selected sensitizing dyes, which may be used singly or in combination of not less than two kinds thereof. Typical spectrally sensitizing dyes advantageously usable in the present invention are those cyanine dyes, merocyanine dyes, and complex cyanine dyes as described in, e.g., U.S. Pat. Nos. 2,269,234, 2,270,378, 2,442,710 and 2,776,280.

The silver halide emulsion layers and nonlight-sensitive layers of the silver halide color photographic light-sensitive material of the present invention may contain various other photographic additives. For example, there may be arbitrarily used those additives such as antifoggants, antistatic agents, brightening agents, antistatic agents, hardening agents, plasticizers, wetting agents, ultraviolet absorbing agents, and the like, as described in Research Disclosure No. 17643.

PRACTICAL APPLICATION OF THE INVENTION

The thus constructed silver halide color photographic light-sensitive material of the present invention is exposed to light and then may be color-developed by various photographic processing methods. The preferred color developer solution used in the present invention contains as the principal component thereof an aromatic primary amine-type color developing agent, which is typified by p-phenylenediamine-type compounds such as, e.g., diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethyl-N-$\beta$-methanesulfonamidoethyl)aminotoluene sulfate, 4-(N-ethyl-N-$\beta$-methanesulfonamidoethylamino)aniline, 4-(N-ethyl-N-$\beta$-hydroxyethylamino)aniline, 2-amino-5-(N-ethyl-$\beta$-methoxyethyl-)aminotoluene, and the like. These color developing agents may be used singly or in combination of not less than two thereof, or used, if necessary, together with a black-and-white developing agent such as hydroquinone or the like. Further, the color developer solution generally contains alkali agents such as, e.g., sodium hydroxide, ammonium hydroxide, sodium carbonate, sodium sulfite, and the like, and further may contain various additives including a halogenated alkali metal such as potassium bromide, development control agent such as, e.g., hydrazinic acid, and the like.

The silver halide photographic light-sensitive material of the present invention may contain in the hydrophilic colloidal layer thereof the foregoing color developing agent as it is or in the precursor form. The color developing agent precursor is a compound capable of producing a color developing agent under an alkaline condition, and includes aromatic aldehyde derivative-Schiff's base-type precursors, multivalent metallic ion complex precursors, phthalic acid imide derivative precursors, phosphoric acid amide precursors, sugar-amine reaction product precursors, and urethane-type precursors. These aromatic primary amine-type color developing agent precursors are as described in, e.g., U.S. Pat. Nos. 3,342,599, 2,507,114, 2,695,234 and 3,719,492; British Patent No. 803,783; Japanese Patent O.P.I. Publication Nos. 135628/1978 and 79035/1979; and Research Disclosure Nos. 15,159, 12,146 and 13,924.

Any of these aromatic primary amine color developing agents or the precursors thereof, when used in development, should be added in such a quantity as to make a sufficient color formation. This quantity depends largely upon the kind or the like of the light-sensitive material used; approximately from 0.1 mole to 5 moles, and preferably from 0.5 mole to 3 moles per mole of light-sensitive silver halide. These color developing agents of the precursors thereof may be used singly or in combination. The incorporation of any of the foregoing compounds into the photographic light-sensitive material may be carried out in any of such manners as adding to the photographic light-sensitive material a solution of the compound dissolved into an appropriate solvent such as water, methanol, ethanol, acetone, or the like; an emulsifiedly dispersed liquid of the compound dispersed by use of such a high-boiling organic solvent as dibutyl phthalate, dioctyl phthalate, tricresyl phosphate, or the like; or a latex polymer into which is impregnated the compound as described in Research Disclosure No. 14850.

The silver halide color photographic light-sensitive material of the present invention, after being color-developed, is usually bleached and fixed separately, or processed in a bleach-fix bath, and then washed. As the bleaching agent for use in the bleaching process there may be used various compounds, among which multivalent metallic compounds such as of iron(III), cobalt (III), tin (II), etc., are mostly used; especially those complex salts of organic acids with these multivalent metallic cations, including metallic complex salts of, e.g., aminopolycarboxylic acids such as ethylenediaminetetraacetic acid, nitrilotriacetic acid, N-hydroxyethylethylenediaminediacetic acid, malonic acid, tartaric acid, malic acid, diglycolic acid, dithioglycolic acid, and the like; or ferricyanates, bichromates, and the like, may be used singly or in an appropriate combination.

EFFECTS OF THE INVENTION

The silver halide photographic light-sensitive material in accordance with the present invention has such advantageous effects that it is excellent in such anti-dark-discoloration characteristics as the resistances to heat and moisture as well as in the resistance to light, and capable of forming a dye image having little or no possibility to become yellowish with time, and thus the overall improvement on the image preservability can be attained. Besides, in the case where the silver halide photographic light-sensitive material of the present invention is a multicolor silver halide color photographic light-sensitive material, the cyan, magenta and yellow dyes will show well-balanced discoloration with time with respect to both dark-discoloration and light-discoloration characteristics, and thus also from this point of view the dye image preservability can be deemed comprehensively improved.

EXAMPLES OF THE INVENTION

The present invention is illustrated further in detail by the following examples, but the embodiments of the present invention are not limited thereto.

EXAMPLE 1

Ten grams of each of the cyan couplers of the present invention as given in Table 1 and the following Comparative Coupler-1 and 3 g of each of the compounds of the present invention having Formula [II] and Formula [III] as given in Table 1 and the following Comparative Dye Image Stabilizers A-1 and A-2 are added and dissolved completely by heating into a mixture of 5 ml of dibutyl phthalate with 30 ml of ethyl acetate. The resulting solution is mixed with 5 ml of an aqueous 10% Alkanol XC (sodium alkylene-naphthalenesulfonate, produced by DuPont) solution and 200 ml of an aqueous 5% gelatin solution, and the mixture is then emulsified by use of an ultrasonic homogenizer to thereby prepare each of the coupler-dispersed liquids.

Each of these dispersed liquids is then added to 500 g of silver chlorobromide (containing 80 mole% of silver bromide) emulsion is coated on a polyethylene-coated paper support, and then dried to thereby prepare 13 different monochromatic photographic element samples. The thus prepared samples 1–20 each is exposed through an optical wedge by use of a sensitometer (Model KS-7, manufactured by Konishiroku Photo Industry Co., Ltd.), and then processed in the following baths in accordance with the steps below:

| Processing Steps | Temperature | Processing Time |
|---|---|---|
| Color developing | 32.8° C. | 3 min. & 30 sec. |
| Bleach-fix | 32.8° C. | 1 min. & 30 sec. |
| Washing | 32.8° C. | 3 min. & 30 sec. |

Compositions of the respective processing baths are as follows:

| Color Developer Composition: | |
|---|---|
| 4-amino-3-methyl-N—ethyl-N—(β-methanesulfonamidoethyl)-aniline sulfate | 5.0 g |
| Benzyl alcohol | 15.0 ml |
| Sodium hexametaphosphate | 2.5 g |
| Anhydrous sodium sulfite | 1.85 g |
| Sodium bromide | 1.4 g |
| Potassium bromide | 0.5 g |
| Borax | 39.1 g |
| Water to make 1 liter. Use sodium hydroxide to adjust the pH to 10.3. | |
| **Bleach-Fix Bath Composition:** | |
| Iron-ammonium ethylenediaminetetraacetate | 61.0 g |
| Diammonium ethylenediaminetetraacetate | 5.0 g |
| Ammonium thiosulfate | 124.5 g |
| Sodium metabisulfite | 13.5 g |
| Anhydrous sodium sulfite | 2.7 g |
| Water to make 1 liter | |

The thus processed samples each was subjected to dye image preservability tests in accordance with the following procedures.

Dye Image Preservability Tests (1) Light-discoloration characteristics (i) Resistance to Light:

Each processed dye image sample was exposed to sunlight over a period of 720 hours with use of an Under-Glass Outdoor Exposure Stand (manufactured by Suga Shikenki, K.K.), and after that the residual dye image density(%) of the area of which the initial density was 1.0 was measured.

(ii) Stain:

An increase(%) in the blue density of the unexposed area of each dye image sample that was used in the above (i) was measured. The values obtained on the samples are indicated in Table 1 as relative values to the value of Sample No. 3 (of the invention) regarded as 100.

(2) Dark-discoloration characteristic

After being allowed to stand over a period of 500 hours in a dark incubation chamber kept at a temperature of 70° C., the samples each was measured with respect to the residual dye image density of the area whose initial density was 1.0.

All the results obtained in the above tests are indicated together in Table 1.

Comparative Coupler-1

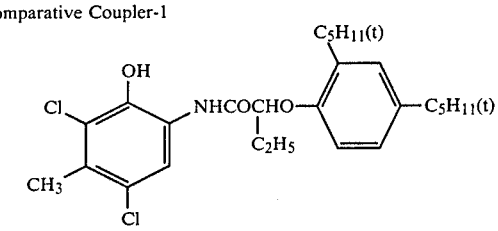

Compound A-1

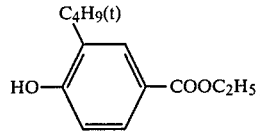

Compound A-2

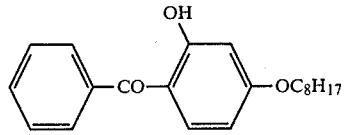

TABLE 1

| Sample No. | Cyan coupler | Dye image stabilizer | *Light-discoloration characteristics: Resistance to light (%) | *Light-discoloration characteristics: Stain | **Dark discoloration characteristic (%) | |
|---|---|---|---|---|---|---|
| 1 | I-5 | | 55 | 108 | 99 | Blank |
| 2 | " | II-47 | 77 | 98 | 100 | Invention |
| 3 | " | III-33 | 76 | 100 | 99 | " |
| 4 | " | A-1 | 55 | 108 | 100 | Comparative |
| 5 | " | A-2 | 56 | 110 | 100 | " |

TABLE 1-continued

| Sample No. | Cyan coupler | Dye image stabilizer | *Light-discoloration characteristics Resistance to light (%) | Stain | **Dark discoloration characteristic (%) | |
|---|---|---|---|---|---|---|
| 6 | I-35 | | 42 | 114 | 99 | Blank |
| 7 | " | II -47 | 71 | 100 | 100 | Invention |
| 8 | " | III-33 | 70 | 100 | 100 | " |
| 9 | " | A-1 | 42 | 112 | 100 | Comparative |
| 10 | " | A-2 | 43 | 114 | 99 | " |
| 11 | I-4 | | 54 | 112 | 100 | Blank |
| 12 | " | II-47 | 75 | 98 | 100 | Invention |
| 13 | " | III-33 | 75 | 100 | 100 | " |
| 14 | " | A-1 | 55 | 112 | 99 | Comparative |
| 15 | " | A-2 | 54 | 110 | 99 | " |
| 16 | Comparative coupler-1 | | 55 | 104 | 61 | Blank |
| 17 | Comparative coupler-1 | II-47 | 69 | 102 | 62 | comparative |
| 18 | Comparative coupler-1 | III-33 | 67 | 104 | 61 | " |
| 19 | Comparative coupler-1 | A-1 | 55 | 104 | 61 | " |
| 20 | Comparative coupler-1 | A-2 | 55 | 104 | 62 | " |

*Light Stability
**Dark Stability

As apparent from Table 1, the silver halide photographic light-sensitive material samples of the present invention show remarkably improved light-discoloration characteristics such as the resistance to light and stain as compared to the silver halide photographic light-sensitive materials containing in combination the conventional dye image stabilizer and 2,5-diacylaminophenol-type cyan coupler, and thus the photographic light-sensitive material of the present invention is considered excellent in the comprehesive dye image stability.

EXAMPLE 2

Multicolor photographic element samples were prepared by coating on a polyethylene-coated paper support the following layers in the described order from the support side.

First layer:

An yellow coupler-containing blue-sensitive silver halide emulsion (90 mole% silver bromide-containing silver chlorobromide emulsion, which also contains 300 g per mole of silver halide of gelatin and 0.5 mole per mole of silver halide of the following yellow coupler YC-1 dispersed after being dissolved into dibutyl phthalate) layer coated and dried so that the coating quantity of the gelatin is 2 g/m$^2$.

Second layer:

A first interlayer (a gelatin layer coated so that the coating quantity of gelatin is 1.5 g/m$^2$).

Third layer:

A magenta coupler-conataining green-sensitive silver halide emulsion (80 mole% silver bromide-containing silver chlorobromide emulsion, which also contains 400 g per mole of silver halide of gelatin and 0.3 mole per mole of silver halide of the following magenta coupler MC-1 dispersed after being dissolved into dibutyl phthalate) layer coated and dried so that the coating quantity of the gelain is 2 g/m$^2$.

Fourth layer:

A second interlayer containing an ultraviolet absorbing agent (a solution of the following ultraviolet absorbing agent dissolved into 20 g of dibutyl phthalate is dispersed into gelatin and coated and dried so that the coating quantities of the ultraviolet absorbing agent and of the gelatin are 0.6 g/m$^2$ and 1.5 g/m$^2$, respectively.)

Fifth layer:

A cyan coupler-containing red-sensitive silver halide emulsion (80 mole% silver bromide-containing silver chlorobromide emulsion, which also contains 300 g per mole of silver halide of gelatin and 0.4 mole per mole of silver halide of each of the exemplified cyan couplers having Formula [I] as given in Table 2 and the same comparative coupler-1 as used in Example 1 and further 35 parts by weight of each of the same exemplified compounds having Formulas [II] and [III] as used in Example 1 per part by weight of the coupler) layer coated and dried so that the quantity of the gelatin is 20 g/m$^2$.

Sixth layer:

A protective layer (a gelatin layer of the coating quantity of gelatin of 1.5 g/m$^2$).

Each of the thus prepared samples 21–40 was exposed to light in the same manner as in Example 1 by use of a sensitometer (Model KS-7, manufactured by Konishiroku Photo Industry Co., Ltd.), provided that each sample was exposed through an optical wedge to blue, green and red lights separately in order to obtain yellow, magenta and cyan monochromatic samples, respectively.

YC-1

-continued

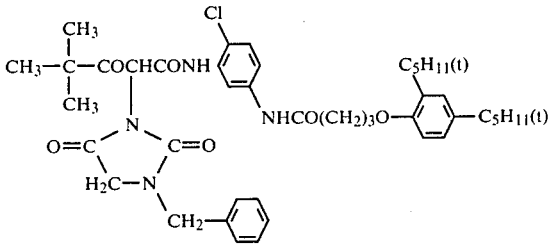

MC-1

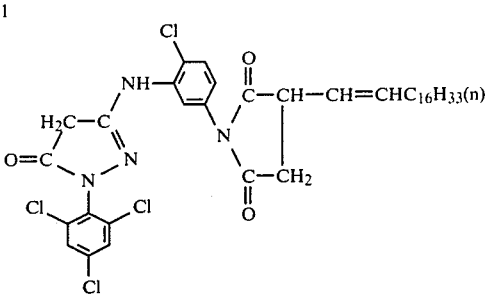

UV-1

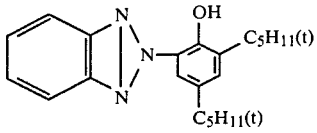

One each of the samples thus processed, the respective tests were applied in the same way as were done in Example 1 for measuring the light resistance and the dark decolorization caused on each of cyan (c), magenta (m) and yellow (y) dye images. The results thereof are shown in Table 2.

TABLE 2

| Sample No. | Cyan coupler | Dye image stabilizer | Resistance to light (%) C | M | Y | Dark discoloration (%) C | M | Y | |
|---|---|---|---|---|---|---|---|---|---|
| 21 | I-5 | — | 56 | 75 | 77 | 100 | 99 | 99 | Blank |
| 22 | " | II-47 | 78 | 76 | " | " | " | 100 | Invention |
| 23 | " | III-33 | 78 | 76 | " | " | 100 | 99 | " |
| 24 | " | A-1 | 56 | 75 | 78 | 99 | 99 | " | Comparative |
| 25 | " | A-2 | 56 | 75 | 77 | 100 | " | 100 | " |
| 26 | I-35 | — | 44 | 74 | 76 | " | 98 | 99 | Blank |
| 27 | " | II-47 | 72 | 74 | 77 | 99 | 99 | 100 | Invention |
| 28 | " | III-33 | 73 | 75 | " | 100 | " | 99 | " |
| 29 | " | A-1 | 44 | 74 | " | " | 100 | 100 | Comparative |
| 30 | " | A-2 | 43 | 74 | " | 99 | 99 | " | " |
| 31 | I-4 | — | 54 | 75 | " | " | 100 | 99 | Blank |
| 32 | " | II-47 | 76 | 75 | " | 100 | 99 | 100 | Invention |
| 33 | " | III-33 | 77 | 76 | 78 | " | 100 | 99 | " |
| 34 | " | A-1 | 54 | 75 | 77 | " | 99 | 100 | Comparative |
| 35 | " | A-2 | 54 | 75 | 76 | " | " | 99 | " |
| 36 | Comparative coupler-1 | — | 55 | 74 | " | 58 | 100 | 100 | " |
| 37 | Comparative coupler-1 | II-47 | 68 | 74 | 77 | " | 99 | 99 | " |
| 38 | Comparative coupler-1 | III-33 | 67 | 75 | " | " | " | " | " |
| 39 | Comparative coupler-1 | A-1 | 55 | 74 | " | 57 | " | " | " |
| 40 | Comparative coupler-1 | A-2 | 55 | 74 | " | " | 100 | 100 | " |

As apparent from Table 2, the samples containing the comparative cyan coupler-1 which is of the known type as used in conventional color printing paper show significantly deteriorated dark-discoloration characteristics. The samples containing the cyan coupler of the present invention alone are remarkably improved on the dark-discoloration characteristics, but deteriorated in respect of the resistance to light, and even the samples containing the coupler of the present invention combined with the comparative dye image stabilizers A-1 and A-2 are still not improved in this respect. In contrast to this, the samples containing the specific cyan coupler of the invention combined with the specific dye image stabilizers of the invention are remarkably improved on the resistance to light, leading to the concurrent improvement on the light-discoloration characteristics accompanied by the well-balanced cyan, magenta and yellow discoloration effect, thus showing the comprehensively improved dye image preservability.

EXAMPLE 3

Similar photographic element samples to those of Example 2 were prepared in the same manner as in Example 2 with the exception that the dibutyl phthalate used in the multicolor photographic element samples of Example 2 was replaced by tricresyl phosphate, the YC-1, MC-1 and UV-1 were replaced by YC-2, MC-2 and UV-2 which are given below, respectively, and the cyan couplers and dye image stabilizers shown in Table 2 were replaced by the cyan couplers and dye image stabilizers given in Table 3, respectively.

Each of the thus obtained 20 different samples was subjected to the same tests as in Example 2. The results are as shown in Table 3.

YC-2

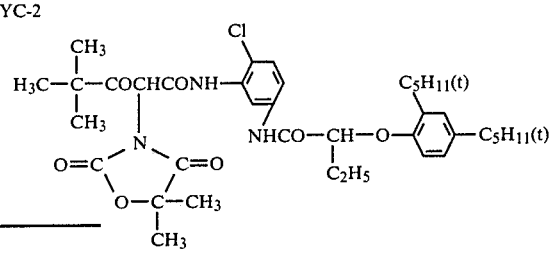

MC-2

-continued

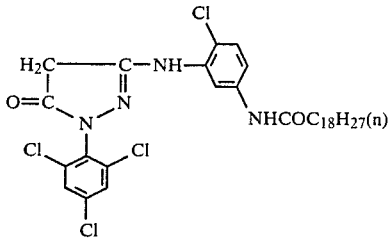

UV-2

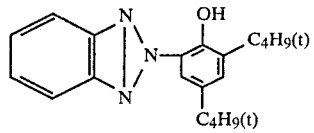

Comparative coupler-2

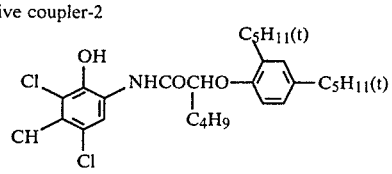

A-3

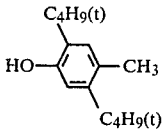

A-4

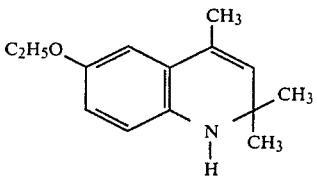

TABLE 3

| Sample No. | Cyan coupler | Dye image stabilizer | Resistance to light (%) C | M | Y | Dark discoloration (%) C | M | Y | |
|---|---|---|---|---|---|---|---|---|---|
| 41 | I-16 | — | 51 | 72 | 73 | 100 | 99 | 99 | Blank |
| 42 | " | II-65 | 75 | 73 | 73 | 100 | 99 | 100 | Invention |
| 43 | " | III-51 | 74 | 73 | 74 | 99 | 98 | 100 | " |
| 44 | " | A-3 | 51 | 73 | 74 | 100 | 99 | 99 | Comparative |
| 45 | " | A-4 | 49 | 72 | 73 | 99 | 99 | 99 | " |
| 46 | I-37 | — | 39 | 72 | 73 | 100 | 99 | 100 | Blank |
| 47 | " | II-65 | 71 | 72 | 74 | 100 | 99 | 100 | Invention |
| 48 | " | III-51 | 73 | 73 | 74 | 100 | 99 | 100 | " |
| 49 | " | A-1 | 40 | 73 | 74 | 100 | 98 | 99 | Comparative |
| 50 | " | A-2 | 38 | 73 | 74 | 99 | 98 | 99 | " |
| 51 | I-32 | — | 49 | 72 | 73 | 100 | 99 | 99 | Blank |
| 52 | " | II-65 | 73 | 73 | 74 | 100 | 99 | 100 | Invention |
| 53 | " | III-51 | 73 | 73 | 74 | 100 | 99 | 100 | " |
| 54 | " | A-3 | 48 | 73 | 73 | 100 | 100 | 100 | Comparative |
| 55 | " | A-4 | 49 | 73 | 73 | 99 | 98 | 99 | " |
| 56 | Comparative coupler-2 | — | 55 | 73 | 73 | 57 | 98 | 99 | " |
| 57 | Comparative coupler-2 | II-65 | 64 | 73 | 74 | 57 | 98 | 99 | " |
| 58 | Comparative coupler-2 | III-51 | 60 | 73 | 73 | 57 | 98 | 100 | " |
| 59 | Comparative coupler-2 | A-3 | 55 | 72 | 73 | 57 | 98 | 100 | " |
| 60 | Comparative coupler-2 | A-4 | 53 | 72 | 73 | 54 | 97 | 99 | " |

As apparent from Table 3, the samples containing the comparative coupler show significantly deteriorated dark-discoloration characteristics. The samples containing the cyan coupler of the present invention alone are remarkably improved on the dark-discoloration characteristics, but deteriorated in respect of the resistance to light, and even those combined with the comparative dye image stabilizers A-3 and A-4 are still not improved in this respect. In contrast, the multicolor photographic element samples containing the specific coupler of the invention combined with the specific dye image stabilizers of the invention are remarkably improved on the light-discoloration characteristic (resistance to light) as well as on the dark-discoloration characteristics, accompanied by the well-balanced cyan, magenta and yellow discoloration effect, thus showing the comprehensively improved dye image preservability.

EXAMPLE 4

Similar samples to those of Example 1 were prepared in the same manner as in Example 1 with the exception that the cyan coupler of the invention as given in Table 4, the compounds of the invention having Formulas [II] and [III] as given in Table 4, and the previously used comparative dye image stabilizers A-1, A-2, A-3 and A-4 were used. These prepared samples each was processed and then tested.

TABLE 4

| Sample No. | Cyan coupler | Dye image stabilizer | Light-discoloration characteristics: Resistance to light (%) | Stain | Dark discoloration characteristics (%) | |
|---|---|---|---|---|---|---|
| 61 | I-41 | — | 55 | 108 | 99 | Blank |
| 62 | " | II-7 | 65 | 102 | 100 | Invention |
| 63 | " | II-15 | 67 | 103 | 100 | " |
| 64 | " | II-23 | 67 | 103 | 99 | " |
| 65 | " | II-36 | 73 | 101 | 100 | " |
| 66 | " | II-49 | 78 | 100 | 100 | " |
| 67 | " | II-53 | 77 | 99 | 100 | " |
| 68 | " | II-61 | 72 | 102 | 99 | " |
| 69 | " | II-75 | 79 | 99 | 100 | " |
| 70 | " | II-78 | 77 | 98 | 100 | " |
| 71 | " | II-2 | 65 | 103 | 99 | " |
| 72 | " | III-28 | 68 | 103 | 100 | " |
| 73 | " | III-31 | 77 | 100 | 100 | " |
| 74 | " | III-35 | 75 | 100 | 100 | " |
| 75 | " | III-46 | 70 | 101 | 99 | " |
| 76 | " | III-47 | 71 | 101 | 100 | " |
| 77 | " | A-1 | 55 | 108 | 100 | comparative |
| 78 | " | A-2 | 55 | 110 | 100 | comparative |

TABLE 4-continued

| Sample No. | Cyan coupler | Dye image stabilizer | Light-discoloration characteristics: Resistance to light (%) | Light-discoloration characteristics: Stain | Dark discoloration characteristics (%) | |
|---|---|---|---|---|---|---|
| 79 | " | A-3 | 51 | 112 | 99 | comparative |
| 80 | " | A-4 | 50 | 111 | 99 | comparative |

As apparent from Table 4, the comparative dye image stabilizers A-1, A-2, A-3 and A-4 have neither light-resistant effect nor antistain effect upon the cyan coupler of the present invention, whereas the dye image stabilizers of the present invention have remarkably improved light-resistant and antistain effects; the effects are conspicuously shown particularly by the compounds having Formulas [V] and [VI].

What is claimed is:

1. In a silver halide photographic light-sensitive material comprising a support having thereon at least one silver halide emulsion layer, said silver halide emulsion layer contains in combination at least one of those cyan couplers having the following Formula I and at least one of those compounds having the following Formula II or III:

Formula I

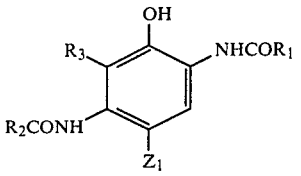

wherein $R_1$ is an aryl radical or a heterocyclic radical; $R_2$ is an alkyl radical or an aryl radical; $R_3$ is a hydrogen atom, a halogen atom, an alkyl radical or an alkoxy radical; and $Z_1$ is a hydrogen atom or a radical that can be split off by the reaction with the oxidized product of an aromatic primary amine color developing agent, Formula II

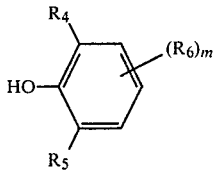

wherein $R_4$ and $R_5$ each is an alkyl radical; $R_6$ is a hydrogen atom, an alkyl radical, an —$NHR_6'$ radical, an —$SR_6'$ radical (wherein $R_6'$ is a monovalent organic radical) or a —$COOR_6''$ radical (wherein $R_6''$ is a hydrogen atom or a monovalent organic radical); and m is an integer of from 0 to 3, Formula III

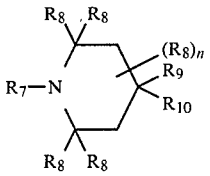

wherein $R_7$ is a hydrogen atom, a hydroxyl radical, an oxy radical (—O radical), an —$SOR_7'$ radical, an —$SO_2R_7''$ radical (wherein $R_7'$ and $R_7''$ each is a monovalent organic radical), an alkyl radical, an alkenyl radical, an alkynyl radical or a —$COR_7'''$ radical (wherein $R_7'''$ is a hydrogen atom or a monovalent organic radical); each $R_8$ is an alkyl radical; $R_9$ and $R_{10}$ each is a hydrogen atom or an —OCOR' radical (wherein R' is a monovalent organic radical), said $R_9$ and said $R_{10}$ together may form a heterocyclic radical; and n is an integer of from 0 to 4.

2. The silver halide photographic light-sensitive material as claimed in claim 1, wherein, in Formula I, an aryl radical represented by $R_1$ is a phenyl radical.

3. The silver halide photographic light-sensitive material as claimed in claim 2, wherein, in Formula I, the radicals represented by the $R_1$ are phenyl radicals or phenylradicals substituted by not less than one halogen atom, alkyl radicals, alkoxy radicals, alkylsulfonamido radicals, arylsulfonamido radicals, alkylsulfamoyl radicals, arylsulfamoyl radicals, alkylsulfonyl radicals, arylsulfonyl radicals, alkylcarbonyl radicals, arylcarbonyl radicals or cyano radicals.

4. The silver halide photographic light-sensitive material as claimed in claim 1, wherein the cyan couplers having Formula [I] are formularized in Formula [IV] below;

Formula [IV]

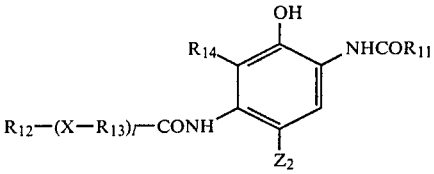

wherein $R_{11}$ is or a phenyl radical; $R_{12}$ is an alkyl radical or an aryl radical; $R_{13}$ is an alkylene radical; $R_{14}$ is a hydrogen atom or a halogen atom; X is a divalent radical such as —O—, —CO—, —COO—, —OCO—, —$SO_2NR_x'$—, —$NR_x'SO_2R_x''$—, —S—, —SO—, or —$SO_2$—, wherein $R_x'$ and $R_x''$ each is an alkyl radical; l is an integer of 0 to five; and, $Z_2$ is a hydrogen atom, or a radical that can be split off by the reaction with the oxidized product of an aromatic primary amine-type color developing agent.

5. The silver halide photographic light-sensitive material as claimed in claim 4, wherein, in Formula [IV], the phenyl radicals represented by $R_{11}$ have a single or a plurality of substituents of a halogen atom, alkylsulfonamide radicals, arylsulfonamide radicals, alkylsulfamoyl radicals, arylsulfamoyl radicals, alkyl radicals, alkoxy radicals or cyano radicals.

6. The silver halide photographic light-sensitive material as claimed in claim 4, wherein, in Formula [IV], the radicals represented by $R_{12}$ are aryl radicals when l is equal to or more than one.

7. The silver halide photographic light-sensitive material as claimed in claim 6, wherein, in Formula [IV], the aryl radicals represented by $R_{12}$ when l is equal to or more than one are phenyl radicals.

8. The silver halide photographic light-sensitive material as claimed in claim 7, wherein, in Formula [IV], the phenyl radicals represented by $R_{12}$ when l is equal to or more than one have a single or a plurality of substituents of alkyl radicals, alkylsulfonamide radicals, arylsulfonamide radicals, aminosulfonamide radicals or alkyloxycarbonyl radicals.

9. The silver halide photographic light-sensitive material as claimed in claim 4, wherein, in Formula [IV], the radicals represented by $R_{12}$ when l is equal to zero are alkyl radicals.

10. The silver halide photographic light-sensitive material as claimed in claim 9, wherein, in Formula [IV], the alkyl radicals represented by $R_{12}$ when l is equal to zero are alkyl radicals each having one to 22 carbon atoms.

11. The silver halide photographic light-sensitive material as claimed in claim 10, wherein, in Formula [IV], the alkyl radicals each having one to 22 carbon atoms represented by $R_{12}$ when l is equal to zero are methyl radicals, ethyl radicals, propyl radicals, butyl radicals, octyl radicals or dodecyl radicals.

12. The silver halide photographic light-sensitive material as claimed in claim 8, wherein, in Formula [IV], an alkyl radical which is a substituent of the phenyl radical represented by $R_{12}$ when l is equal to or more than one is a t-butyl radical, a t-amyl radical or an octyl radical; an alkylsulfonamide radical which is a substituent thereof is a butylsulfonamide radical, an octylsulfonamide radical or a dodecylsulfonamide radical; an arylsulfonamide radical which is a substituent thereof is a phenylsulfonamide radical; an aminosulfonamide radical which is a substituent thereof is a dimethylaminosulfonamide radical; and an alklyloxycarbonyl radical which is a substituent thereof is a methyloxycarbonyl radical or a butyloxycarbonyl radical.

13. The silver halide photographic light-sensitive material as claimed in claim 4, wherein, in Formula [IV], the alkylene radicals represented by $R_{13}$ are straight-chain or branched-chain alkylene radicals each having one to 20 carbon atoms.

14. The silver halide photographic light-sensitive material as claimed in claim 13, wherein, in Formula [IV], the straight-chain or branched-chain alkylene radicals each having one to 20 carbon atoms represented by $R_{13}$ are alkylene radicals each having one to 12 carbon atoms.

15. The silver halide photographic light-sensitive material as claimed in claim 4, wherein, in Formula [IV], the radicals represented by $R_{14}$ are hydrogen atoms.

16. The silver halide photographic light-sensitive material as claimed in claim 4, wherein, in Formula [IV], the divalent radicals represented by X are —O—, —S—, —SO— or —$SO_2$— radicals.

17. The silver halide photographic light-sensitive material as claimed in claim 4, wherein, in Formula [IV], l is equal to zero or one.

18. The silver halide photographic light-sensitive material as claimed in claim 4, wherein, in Formula [IV], the radical represented by $Z_2$ is hydrogen atom or chlorine atom.

19. The silver halide photographic light-sensitive material as claimed in claim 1, wherein, in Formula [II], the alkyl radicals represented respectively by $R_4$ and $R_5$ are alkyl radicals each having one to 12 carbon atoms.

20. The silver halide photographic light-sensitive material as claimed in claim 19, wherein, in Formula [II], the alkyl radicals each having one to 12 carbon atoms represented respectively by $R_4$ and $R_5$ are alkyl radicals each which are branched in the $\alpha$ position thereof and have 3 to 8 carbon atoms each.

21. The silver halide photographic light-sensitive material as claimed in claim 20, wherein, in Formula [II], the alkyl radical being represented by $R_4$ and $R_5$, having a branched-chain in the $\alpha$ position thereof and having 3 to 8 carbon atoms, is a t-butyl radical or a t-pentyl radical.

22. The silver halide photographic light-sensitive material as claimed in claim 1, wherein, in Formula [II], the monovalent organic radicals each represented respectively by $R_6'$ and $R_6''$ are alkyl radicals, cycloalkyl radicals, aryl radicals or heterocyclic radicals.

23. The silver halide photographic light-sensitive material as claimed in claim 1, wherein the compounds having Formula [II] are compounds having the Formula [V] below:

Formula [V]

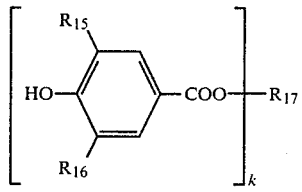

wherein $R_{15}$ and $R_{16}$ each is a straight-chain or branched-chain alkyl radical having from 3 to 8 carbon atoms, $R_{17}$ is a k-valent organic radical; and k is an integer of from 1 to 6.

24. The silver halide photographic light-sensitive material as claimed in claim 23, wherein, in Formula [V], the straight-chain or branched-chain alkyl radicals each having 3 to 8 carbon atoms represented by $R_{15}$ and $R_{16}$ are t-butyl radicals or t-pentyl radicals.

25. The silver halide photographic light-sensitive material as claimed in claim 23, wherein, in Formula [V], the organic radical represented by $R_{17}$ is an alkyl radical, an alkenyl radical, a multivalent unsaturated hydrocarbon radical, an unsaturated hydrocarbon radical, an alicyclic hydrocarbon radical, an aryl radical, an arylene radical, or a 1,3,5-tri-substituted benzene radical.

26. The silver halide photographic light-sensitive material as claimed in claim 23, wherein, in Formula [V], the organic radical represented by $R_{17}$ is an organic radical combined through an —O— radical, an —S— radical or an —$SO_2$— radical.

27. The silver halide photographic light-sensitive material as claimed in claim 25, wherein, in Formula [V], the organic radical represented by $R_{17}$ is 2,4-di-t-bytylphenyl, 2,4,-di-t-pentylphenyl, p-octylphenyl, p-dodecylphenyl, 3,5-di-t-butyl-4-hydroxylphenyl or 3,5-di-t-pentyl-4-hydroxylphenyl radical.

28. The silver halide photographic light-sensitive material as claimed in claim 23, wherein, in Formula [V], k is an integer of from 1 to 4.

29. The silver halide photographic light-sensitive material as claimed in claim 1, wherein, in Formula [III], the alkyl radical represented by $R_7$ has one to 12 carbon atoms, the alkenyl or alkinyl radical has two to four carbon atoms, and the monovalent organic radicals each represented respectively by $R_7'$, $R_7''$ and $R_7'''$ in the —$SOR_7'$, —$SOR_7''$ and —$COR_7'''$ radicals are alkyl, alkenyl, alkinyl or aryl radicals.

30. The silver halide photographic light-sensitive material as claimed in claim 1, wherein, in Formula [III], the radicals represented by $R_7$ is hydrogen atom, alkyl radicals, alkenyl radicals, alkinyl radicals or —$COR_7'''$ radicals in which $R_7'''$ represents an alkyl radical, an alkenyl radical, an alkinyl radical, or an aryl radical.

31. The silver halide photographic light-sensitive material as claimed in claim 1, wherein, in Formula [III], the alkyl radical represented by $R_8$ is a straight-chain or branched-chain alkyl radical having one to five carbon atoms.

32. The silver halide photographic light-sensitive material as claimed in claim 31, wherein, in Formula [III], the alkyl radical represented by $R_8$ is methyl radical.

33. The silver halide photographic light-sensitive material as claimed in claim 1, wherein, in Formula [III], the monovalent organic radical represented by R' in the —OCOR' radicals represented respectively by $R_9$ and $R_{10}$ is an alkyl radical, an alkenyl radical, an alkinyl radical, an aryl radical, an alkylamino radical or an arylamino radical.

34. The silver halide photographic light-sensitive material as claimed in claim 1, wherein, in Formula [III], the heterocyclic radical formed by $R_9$ and $R_{10}$ in association is a radical having the Formula below:

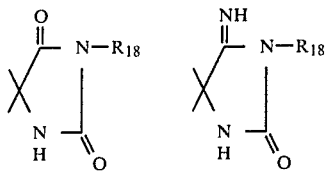

wherein $R_{18}$ is a hydrogen atom, an alkyl radical, a cycloalkyl radical or a phenyl radical.

35. The silver halide photographic light-sensitive material as claimed in claim 1, wherein the compounds each having Formula [III] are compounds having the Formula [VI] below:

Formula [VI]

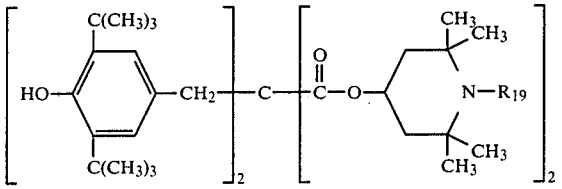

wherein $R_{19}$ is an alkyl radical, an alkenyl radical, an alkinyl radical, or an acyl radical.

36. The silver halide photographic light-sensitive material as claimed in claim 35, wherein, in Formula [VI], the radical represented by $R_{19}$ is methyl, ethyl, vinyl, allyl, propinyl, benzyl, acetyl, propionyl, acryloyl, methacryloyl, or crotonoyl radical.

37. The silver halide photographic light-sensitive material as claimed in claim 1, wherein the silver halide emulsion contains the compound having Formulas [II] and [III] of five to 300 parts by weight per 100 parts by weight of the cyan coupler having Formula [I].

38. The silver halide photographic light-sensitive material as claimed in claim 37, wherein the silver halide emulsion contains the compound having Formulas [II] and [III] of ten to 100 parts by weight per 100 parts by weight of the cyan coupler having Formula [I].

39. The silver halide photographic light-sensitive material as claimed in claim 1, wherein the silver halide emulsion contains the cyan coupler having Formula [I] in the range of 0.1 to one mole per mole of the silver halide.

40. The silver halide photographic light-sensitive material as claimed in claim 1, comprising a support having thereon a cyan dye image-formable component unit comprising at least one red-sensitive silver halide emulsion layer containing cyan dye-forming couplers (at least one of the cyan couplers is the cyan coupler of the invention having Formula [I]); a magenta dye image-formable component unit comprising at least one green-sensitive silver halide emulsion layer containing at least one magenta dye-forming coupler; and an yellow dye image-formable component unit comprising at least one blue-sensitive silver halide emulsion layer containging at least one yellow dye-forming coupler.

41. The silver halide photographic light-sensitive material as claimed in claim 40, wherein the yellow dye-forming coupler is a compound having Formula [VII] below:

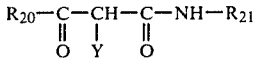

Formula [VII]

wherein $R_{20}$ is an alkyl radical or an aryl radical; $R_{21}$ is an aryl radical; and Y is a hydrogen atom or a radical that can be split off during the course of a color developing reaction.

42. The silver halide photographic light-sensitive material as claimed in claim 41, wherein the yellow dye-forming coupler is a compound having Formula [VIII] below:

Formula [VIII]

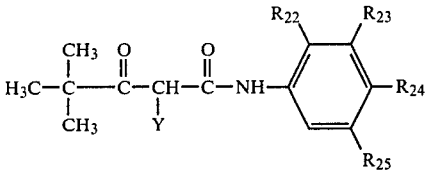

wherein $R_{22}$ is a halogen atom, an alkoxy radical or an aryloxy radical; $R_{23}$, $R_{24}$ and $R_{25}$ each is a hydrogen atom, a halogen atom, an alkyl radical, an alkenyl radical, an alkoxy radical, an aryl radical, an aryloxy radical, a carbonyl radical, a sulfonyl radical, a carboxyl radical, an alkoxycarbonyl radical, a carbamyl radical, a sulfone radical, a sulfamyl radical, a sulfonamido radical, an acylamido radical, an ureido radical or an amino radical; and Y is a radical synonymous with those having Formula [VII].

43. The silver halide photographic light-sensitive material as claimed in claim 40, wherein the magenta dye-forming coupler is a compound having Formula [IX] below:

Formula [IX]

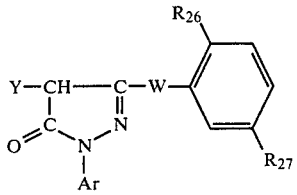

wherein Ar is an aryl radical; $R_{26}$ is a hydrogen atom, a halogen atom, an slkyl radical or an alkoxy radical; $R_{27}$ is an alkyl radical, an amido radical, an imido radical, an N-alkylcarbamoyl radical, an N-alkylsulfamoyl radical, an alkoxycarbonyl radical, an acyloxy radical, a sulfonamido radical or an ureido radical; Y is as defined in Formula [VII]; and W is —NH—, —NHCO— (wherein the N atom is bonded with the carbon atom of the pyrazolone nucleus) or —NHCONH—.

* * * * *